US012774585B2

(12) United States Patent
Young et al.

(10) Patent No.: US 12,774,585 B2
(45) Date of Patent: Oct. 27, 2026

(54) SYSTEMS AND METHODS FOR POWER MODES FOR ELECTRICALLY POWERED POWER MACHINES

(71) Applicant: Doosan Bobcat North America, Inc., West Fargo, ND (US)

(72) Inventors: Christopher Young, Fargo, ND (US); Joel Honeyman, Horace, ND (US); John Pfaff, Bismarck, ND (US)

(73) Assignee: Doosan Bobcat North America, Inc., West Fargo, ND (US)

( * ) Notice: Subject to any disclaimer, the term of this patent is extended or adjusted under 35 U.S.C. 154(b) by 540 days.

(21) Appl. No.: 18/168,841

(22) Filed: Feb. 14, 2023

(65) Prior Publication Data

US 2023/0279641 A1 Sep. 7, 2023

Related U.S. Application Data

(60) Provisional application No. 63/310,445, filed on Feb. 15, 2022.

(51) Int. Cl.

| | |
|---|---|
| ***E02F 9/20*** | (2006.01) |
| ***E02F 3/34*** | (2006.01) |
| ***E02F 3/96*** | (2006.01) |

(52) U.S. Cl.

CPC ..... *E02F 9/2095* (2013.01); *E02F 3/96* (2013.01); *E02F 9/2004* (2013.01); *E02F 3/3414* (2013.01)

(58) Field of Classification Search

CPC ..... E02F 9/2095; E02F 3/96; E02F 9/2004; E02F 3/3414; E02F 9/207

See application file for complete search history.

(56) References Cited

U.S. PATENT DOCUMENTS

| | | | |
|---|---|---|---|
| 6,078,855 | A | 6/2000 | Kinugawa et al. |
| 9,187,880 | B2 | 11/2015 | Tsuruga et al. |
| 9,802,600 | B2 | 10/2017 | Nanjo et al. |

(Continued)

FOREIGN PATENT DOCUMENTS

| | | | |
|---|---|---|---|
| CN | 209365888 | U | 9/2019 |
| CN | 111236353 | A | 6/2020 |

(Continued)

OTHER PUBLICATIONS

International Searching Authority, International Search Report and Written Opinion from the corresponding International Application No. PCT/US2023/062558, mailed Jul. 25, 2023 [ 11 pgs.].

*Primary Examiner* — Kyle J Kingsland
(74) *Attorney, Agent, or Firm* — Quarles & Brady LLP

(57) ABSTRACT

A control device for a power machine can be configured to receive a request to initiate a power burst mode for the power machine, wherein the power burst mode defines one or more operational parameters for increasing an amount of power used by at least one of the plurality of electrical actuator. The control device may receive data associated with one or more operational conditions of the power machine and assess a power burst constraint associated with the power burst mode. In response to the power burst constraint being satisfied, the control device may control power to at least one of the plurality of electrical actuators according to the one or more operational parameters of the power burst mode.

15 Claims, 8 Drawing Sheets

(56) References Cited

U.S. PATENT DOCUMENTS

| | | | | |
|---|---|---|---|---|
| 2005/0150143 | A1* | 7/2005 | Charles | F04B 49/06 37/414 |
| 2011/0276238 | A1* | 11/2011 | Toda | F02D 41/021 701/50 |
| 2016/0312432 | A1* | 10/2016 | Wang | E02F 9/2012 |
| 2019/0112787 | A1* | 4/2019 | Hunold | E02F 3/32 |
| 2022/0010527 | A1* | 1/2022 | Takeo | E02F 9/2228 |
| 2022/0316502 | A1 | 10/2022 | Cliff | |
| 2023/0085676 | A1* | 3/2023 | Hijikata | E02F 9/2004 60/413 |

FOREIGN PATENT DOCUMENTS

| | | | |
|---|---|---|---|
| CN | 111749300 | A | 10/2020 |
| CN | 216733906 | U | 6/2022 |
| CN | 217048290 | U | 7/2022 |
| EP | 2518219 | A1 | 10/2012 |
| JP | 2001226077 | A | 8/2001 |

* cited by examiner

SYSTEMS AND METHODS FOR POWER MODES FOR ELECTRICALLY POWERED POWER MACHINES

CROSS-REFERENCE TO RELATED APPLICATIONS

This application claims the benefit of and priority to U.S. Provisional Application No. 63/310,445, filed Feb. 15, 2022, the entirety of which is incorporated by reference herein.

BACKGROUND

This disclosure is directed toward power machines. More particularly, the present disclosure is directed to power machines that operate in whole or in part under electrical power. Power machines, for the purposes of this disclosure, include any type of machine that generates power for the purpose of accomplishing a particular task or a variety of tasks. One type of power machine is a work vehicle. Work vehicles, such as loaders, are generally self-propelled vehicles that have a work device, such as a lift arm (although some work vehicles can have other work devices) that can be manipulated to perform a work function. Work vehicles include loaders, excavators, utility vehicles, tractors, and trenchers, to name a few examples.

Conventional power machines can include hydraulic systems and related components that are configured to use output from a power source (e.g., an internal combustion engine) to perform different work functions. More specifically, hydraulic motors can be configured to power movement of a power machine, and hydraulic actuators (e.g., hydraulic cylinders) can be used to move a lift arm structure attached to the power machine, to tilt or otherwise move an implement connected to the lift arm structure, or execute other operations.

The discussion above is merely provided for general background information and is not intended to be used as an aid in determining the scope of the claimed subject matter.

SUMMARY OF THE DISCLOSURE

Some embodiments of the disclosure are directed to improvements in the power management of electrically powered power machines to manage (e.g., conserve or optimally allocate) the power of an electrical power source. In this way, for example, the total run-time of the power machine can be increased to complete a work task (e.g., digging) without requiring that the electrical power source to be recharged during the work task. Further, in some power modes, power can temporarily be provided to one or more actuators at a rate that exceeds a standard rated power for a particular actuator or operating mode.

According to some aspects of the disclosure, a power machine can include a main frame, one or more work elements supported by the main frame, a plurality of electrical actuators coupled to the main frame and configured to operate the one or more work elements, and an electrical power source configured to power the plurality of electrical actuators. A control device in communication with the plurality of electrical actuators can be configured to: during operation of the power machine in a standard operating mode, receive a request to initiate a power burst mode for the power machine, wherein the power burst mode defines one or more operational parameters for increasing an amount of power used by at least one of the plurality of electrical actuators above a power threshold for the standard operating mode. The control device can be further configured to compare one or more operational conditions of the power machine to one or more power burst thresholds associated with the power burst mode, and, in response to the comparison indicating that at least one power burst threshold of the one or more power burst thresholds has been satisfied, control an increase of power to the at least one of the plurality of electrical actuators according to the one or more operational parameters of the power burst mode.

According to some aspects of the disclosure, method for operating a power machine can include receiving, with a control device, a first request to initiate a first power burst event of a power burst mode for the power machine, wherein the power burst mode defines one or more operational parameters for controlling an amount of power used by one or more of a plurality of electrical actuators in excess of a corresponding power threshold of a current power mode. Based on operational data of the power machine, the control device can assess a power burst constraint associated with one or more of the power machine or the current power mode. In response to the power burst constraint being satisfied, the control device can initiate the first power burst event for the power machine to control, for a first set of electrical actuators included in the plurality of electrical actuators, delivery or use of power in excess of the corresponding power threshold and can then end the first power burst event in response to detecting a first termination condition associated with the power burst mode. In response to the power burst constraint not being satisfied, the control device can select to not initiate the first power burst event based on the first request.

This Summary and the Abstract are provided to introduce a selection of concepts in a simplified form that are further described below in the Detailed Description. The Summary and the Abstract are not intended to identify key features or essential features of the claimed subject matter, nor are they intended to be used as an aid in determining the scope of the claimed subject matter.

BRIEF DESCRIPTION OF THE DRAWINGS

The following drawings are provided to help illustrate various features of non-limiting examples of the disclosure and are not intended to limit the scope of the disclosure or exclude alternative implementations.

DETAILED DESCRIPTION OF THE PRESENT DISCLOSURE

Figure 1:
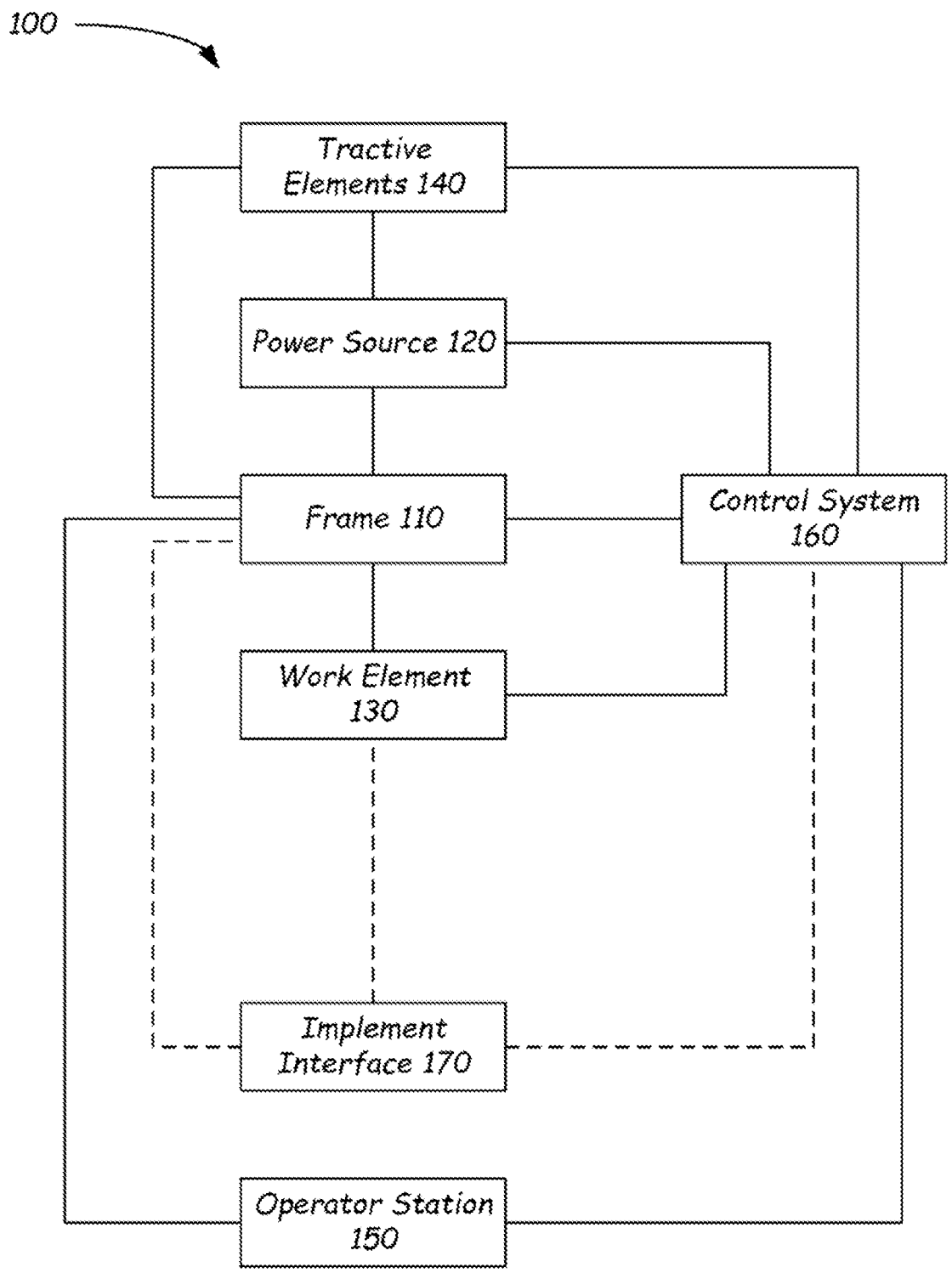
FIG. 1 is a block diagram illustrating functional systems of a representative power machine on which embodiments of the present disclosure can be practiced.

The concepts disclosed in this discussion are described and illustrated by referring to exemplary embodiments.

These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

As described above, typical skid-steer loaders (and other power machines) can include a hydraulic system and an internal combustion engine that powers the hydraulic system. The internal combustion engine can thus indirectly power one or more actuators of the hydraulic system to propel the loader, to move a lift arm of the loader, to move an implement coupled to the lift arm of the loader, etc. While hydraulically powered power machines can be effective, electrically powered power machines can offer certain comparative improvements. For example, electrically powered power machine (e.g., a skid-steer loader) can provide increased operational power, improved packaging and control, improved local environmental impact (e.g., due to lack of exhaust), and other benefits.

In some embodiments, an electrically powered power machine can include an electrical power source (e.g., a battery pack including one or more battery cells) that can power one or more electrical actuators of the power machine, each of which can implement a functionality for the power machine (e.g., move the lift arm, drive travel of the power machine, move an implement or other work element of the power machine, etc.). Although this arrangement can be useful, including for reasons generally noted above, conventional arrangements may exhibit certain disadvantages, including as compared to hydraulically powered power machines. For example, the total amount of energy storage at full charge of an electrical power source of a conventional electrically powered power machine can sometimes be less than the total amount of energy storage at full-fueling of a conventional combustion-powered power machine (e.g., because fuel can be more energy dense than an electrical battery pack). Thus, the total amount of energy at full charge of an electrical power source of a power machine can be limiting, with unmetered usage of the power machine having the potential to deplete a battery pack too quickly. This, in turn, can prevent the electrically powered machine from completing a task (e.g., moving an amount of dirt, flattening a region of the ground, etc.) on only a single full charge.

Some embodiments of this disclosure can address these issues (and others) by providing improved power management systems and methods for an electrically powered power machine. For example, some embodiments provide an electrically powered power machine that can operate according to different power management modes, each with different operational parameters that define the way in which power is to be routed or consumed by different power sinks (e.g., electrical actuators for traction, workgroup function, etc.). As a more specific example, an operational parameter of a power management mode can be a power threshold for one or more electrical actuators or for a power machine as a whole, which can inform control of the one or more electrical actuators (or other systems) to prevent the one or more electrical actuators or the power machine as a whole from drawing excessive power. In this way, for example, for a given operator command, power consumption by one or more corresponding actuators can sometimes be decreased, according to operational parameters of the selected power management mode, to thereby conserve the energy stored in the electrical power source. Thus, for example, the total operation time for the electrically powered power machine can be prolonged through appropriate use of one or more power management modes. Similarly, in some cases, operators can be provided with different levels of available power (e.g., overall or for particular actuators) depending on the selected power management mode, as may facilitate more efficient execution of certain work operations.

In some embodiments, a power management mode can prioritize the power delivery and consumption for certain electrical loads of an electrically powered power machine. For example, when an electrically powered power machine operates according to a first power management mode, if the relevant power draw (e.g., by one or more electrical actuators, collectively) exceeds a power threshold that corresponds to the first mode, then the power machine can decrease power consumption by one or more electrical loads that have a lower priority. In different power management modes, different electrical loads (e.g., different electrical actuators) may be given priority. For example, in one mode, a workgroup (e.g., lift) electrical actuator can have higher priority than a drive electrical actuator (i.e., an actuator to provide tractive power to propel the power machine forwards, rearwardly, etc.). In this case, for example, if the present power usage exceeds a power threshold, then the power machine can decrease the power draw of the drive actuator (e.g., thereby slowing the speed of the drive actuator and ground speed of the power machine). As another example, ancillary electrical loads including, for example, a climate control system (e.g., an air conditioning system), a speaker system, a radio, a display, etc., can have a lower priority than the one or more actuators for workgroup or tractive operations. In this case, for example, if a present power usage exceeds a power threshold, then the power machine can decrease the power draw of one or more of the ancillary electrical loads, which can include stopping power draw from the one or more ancillary electrical loads. In this way, the electrically powered power machine can conserve the energy stored in the electrical power source, thus prolonging the total operation time for the electrically powered power machine.

In some embodiments, a power machine can be configured to be operated under a temporary power burst mode, in which power delivery to select one or more actuators is increased beyond a rated power for the one or more actuators for a default or current power management mode. For example, if a power machine is operating in a normal power mode, drive motors, lift actuators, tilt actuators, etc. may be rated to a particular rated power (i.e., practically limited in operation to the rated power), which may correspond to a lower rate of power delivery than a power source of the power machine is actually capable of providing. Operating at power that exceeds a rated power can be detrimental to power machine systems over sufficiently long periods. However, with appropriate management of burst mode constraints (i.e., thresholds or other conditions to be met before a burst mode or burst event can be commenced or continued), control systems according to some embodiments of the disclosure can effectively provide temporary increases in power during burst mode operation, including at power delivery rates beyond a rated power of one or more actuators, and in response to specific operator inputs.

In some embodiments, electrical actuators can be controlled to cause a fluctuating movement of an implement or other work element of a power machine over multiple cycles. As used herein in this context, "fluctuating movement" (or, generally, a "fluctuation") indicates a regular or irregular oscillation relative to a reference orientation (or range of orientations). Similarly, "cycle" collectively indicates a first movement of a fluctuating movement in a first direction and a subsequent movement of the fluctuating movement in a second direction. In some cases, a fluctuating movement of an implement (e.g., a bucket) can include a movement that causes an attitude (or other orientation) of the implement to alternately change in opposite directions relative to a reference attitude (or other orientation), including a starting attitude of the implement when the fluctuating movement is initiated (i.e., so that the fluctuation is centered or otherwise anchored relative to a starting attitude). In some cases, a change in orientation under a fluctuating movement can be part of a regular oscillation, with a constant frequency/period. In some cases, such a change can be part of an irregular oscillation, with a varying frequency/period. In some cases, an amplitude of the opposing movements of a commanded fluctuating movement can be constant over multiple cycles. In some cases, the opposing movements can be symmetrical in time or amplitude (e.g., in attitudinal deviation from a reference attitude). In some cases, the opposing movements can be non-symmetrical in time or amplitude).

In some cases, a fluctuating movement can be commanded to provide a shaking operation, which can rapidly move a bucket or other implement in alternating opposing directions, to help to shake free material (such as mud) from the implement, facilitate cutting or digging operations, or otherwise improve particular work operations. For example, a fluctuating movement can be implemented during a dumping operation (e.g., an automatic dumping operation) to help shake dug material from a bucket into a truck bed or dump pile. As another example, a fluctuating movement can be implemented during a digging operation (e.g., an automatic digging operation) to help a cutting edge of a bucket or other implement move more easily through compacted soil or other material.

In some cases, a fluctuating movement can be commanded automatically based on sensed operational conditions for a power machine. For example, a control device can be configured to identify an increase in load on an implement during digging, a manual or automatic bucket-dump command, or other operational condition and then to implement appropriate fluctuating movements accordingly. In some cases, a fluctuating movement can be commanded based on an operator input. For example, an operator input at a joystick or other input device may generally command a fluctuating movement for an implement, without directly commanding the particular movement of the implement that constitute the fluctuating movement (e.g., may indicate that a bucket shake should be executed, but not directly command the particular extension and retraction of a tilt actuator). As another example, an operator input at a joystick or other input device may command a fluctuating movement, including indicating an amplitude, frequency, or other parameter of the particular extension and retraction movements. In such a case, a control device may sometimes directly implement the particular movements commanded by the operator or may modify the operator inputs to provide a more optimal fluctuating movement (e.g., may modulate the commanded amplitude or frequency to approach or avoid a particular natural frequency, to provide faster or more regular fluctuation cycles, etc.). By modifying operator inputs or operating in response to a single operator input such as depressing a button or moving a variable sliding input, a control device can provide better fluctuating movements to accomplish a particular task. In other words, the control device can select a particular amplitude and/or frequency to optimize the fluctuation, given a particular task (different types of material that might need to be dug or shook from a bucket). In some cases, providing an operator a variable input such as a rotary paddle, an operator may be able to dynamically adjust the fluctuation pattern in response to different conditions.

Figure 2:
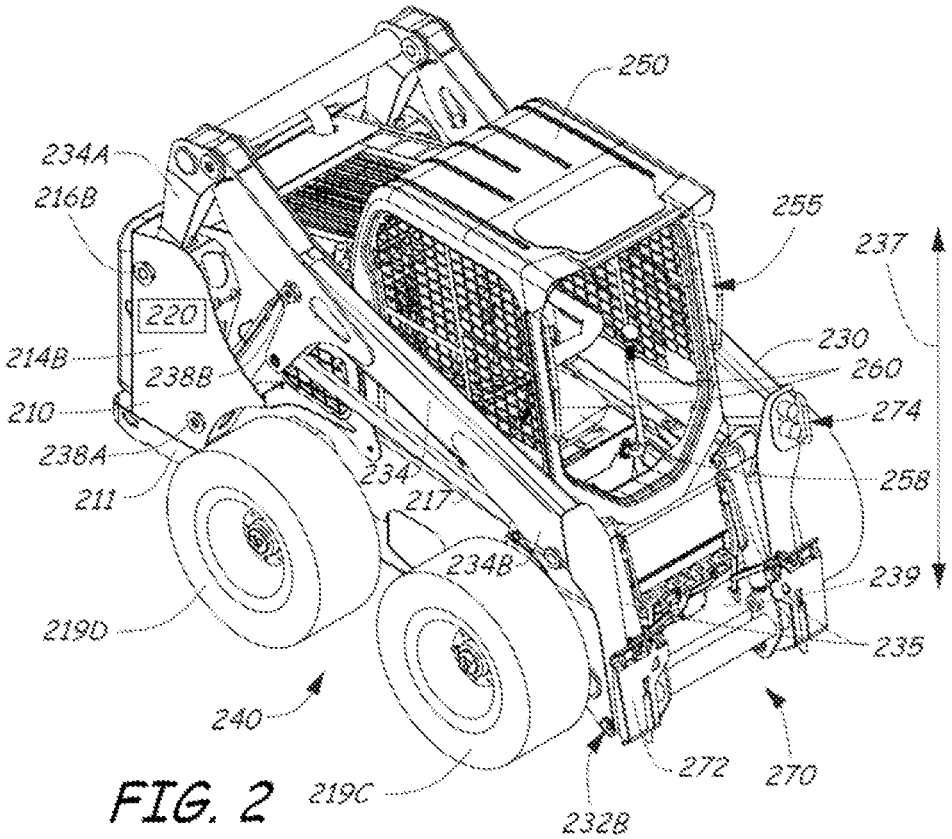
FIG. 2 is a perspective view showing generally a front of a power machine on which embodiments disclosed in this specification can be advantageously practiced.
Figure 3:
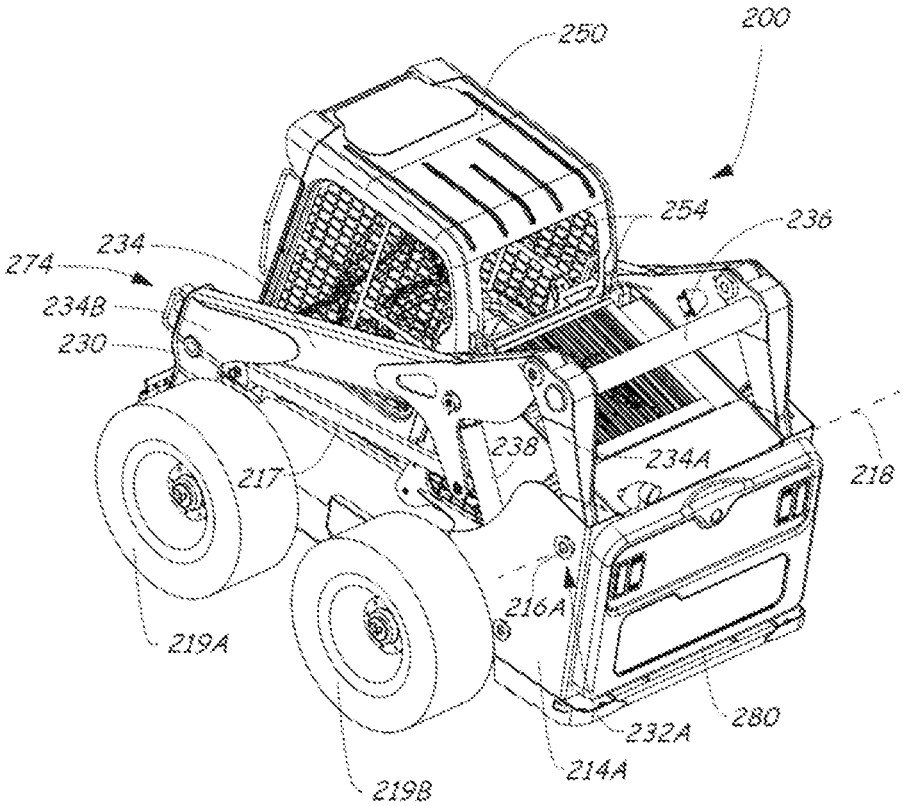
FIG. 3 is a perspective view showing generally a back of the power machine shown in FIG. 2.

These concepts can be practiced on various power machines, as will be described below. A representative power machine on which the embodiments can be practiced is illustrated in diagram form in FIG. 1 and one example of such a power machine is illustrated in FIGS. 2-3 and described below before any embodiments are disclosed. For the sake of brevity, only one power machine is illustrated and discussed as being a representative power machine. However, as mentioned above, the embodiments below can be practiced on any of a number of power machines, including power machines of different types from the representative power machine shown in FIGS. 2-3. Power machines, for the purposes of this discussion, include a frame, at least one work element, and a power source that can provide power to the work element to accomplish a work task. One type of power machine is a self-propelled work vehicle. Self-propelled work vehicles are a class of power machines that include a frame, work element, and a power source that can provide power to the work element. At least one of the work elements is a motive system for moving the power machine under power.

FIG. 1 is a block diagram that illustrates the basic systems of a power machine 100, which can be any of a number of different types of power machines, upon which the embodiments discussed below can be advantageously incorporated. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that can perform a dedicated task. For example, some work vehicles have a lift arm to which an implement such as a bucket is attached such as by a pinning arrangement. The work element, i.e., the lift arm can be manipulated to position the implement to perform the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of different implements to the work element. One characteristic of such an implement carrier is that once an implement is attached to it, it is fixed to the implement (i.e. not movable with respect to the implement) and when the implement carrier is moved with respect to the work element, the implement moves with the implement carrier. The term implement carrier as used herein is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that can move with respect to another portion of the frame. For example, excavators can have an upper frame portion that rotates with respect to a lower frame portion. Other work vehicles have articulated frames such that one portion of the frame pivots with respect to another portion for accomplishing steering functions.

Frame 110 supports the power source 120, which is configured to provide power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that is configured to convert the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. For example, the power machine can be a mower with a mower deck or other mower component as a work element, which may be movable with respect to the frame of the mower. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, track assemblies, wheels attached to an axle, and the like. Tractive elements can be mounted to the frame such that movement of the tractive element is limited to rotation about an axle (so that steering is accomplished by a skidding action) or, alternatively, pivotally mounted to the frame to accomplish steering by pivoting the tractive element with respect to the frame.

Power machine 100 includes an operator station 150 that includes an operating position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether or not they have operator compartments or operator positions, may be capable of being operated remotely (i.e., from a remotely located operator station) instead of or in addition to an operator station adjacent or on the power machine. This can include applications where at least some of the operator-controlled functions of the power machine can be operated from an operating position associated with an implement that is coupled to the power machine. Alternatively, with some power machines, a remote-control device can be provided (i.e., remote from both of the power machine and any implement to which is it coupled) that is capable of controlling at least some of the operator-controlled functions on the power machine.

FIGS. 2-3 illustrate a loader 200, which is one particular example of a power machine of the type illustrated in FIG. 1 where the embodiments discussed below can be advantageously employed. Loader 200 is a skid-steer loader, which is a loader that has tractive elements (in this case, four wheels) that are mounted to the frame of the loader via rigid axles. Here the phrase "rigid axles" refers to the fact that the skid-steer loader 200 does not have any tractive elements that can be rotated or steered to help the loader accomplish a turn. Instead, a skid-steer loader has a drive system that independently powers one or more tractive elements on each side of the loader so that by providing differing tractive signals to each side, the machine will tend to skid over a support surface. These varying signals can even include powering tractive element(s) on one side of the loader to move the loader in a forward direction and powering tractive element(s) on another side of the loader to mode the loader in a reverse direction so that the loader will turn about a radius centered within the footprint of the loader itself. The term "skid-steer" has traditionally referred to loaders that have skid steering as described above with wheels as tractive elements. However, it should be noted that many track loaders also accomplish turns via skidding and are technically skid-steer loaders, even though they do not have wheels. For the purposes of this discussion, unless noted otherwise, the term skid-steer should not be seen as limiting the scope of the discussion to those loaders with wheels as tractive elements. Correspondingly, although some example power machines discussed herein are presented as skid-steer power machines, some embodiments disclosed herein can be implemented on a variety of other power machines. For example, some embodiments can be implemented on compact loaders or compact excavators that do not accomplish turns via skidding.

Loader 200 is one particular example of the power machine 100 illustrated broadly in FIG. 1 and discussed above. To that end, features of loader 200 described below include reference numbers that are generally similar to those used in FIG. 1. For example, loader 200 is described as having a frame 210, just as power machine 100 has a frame 110. Skid-steer loader 200 is described herein to provide a reference for understanding one environment on which the embodiments described below related to track assemblies and mounting elements for mounting the track assemblies to a power machine may be practiced. The loader 200 should not be considered limiting especially as to the description of features that loader 200 may have described herein that are not essential to the disclosed embodiments and thus may or may not be included in power machines other than loader 200 upon which the embodiments disclosed below may be advantageously practiced. Unless specifically noted otherwise, embodiments disclosed below can be practiced on a variety of power machines, with the loader 200 being only one of those power machines. For example, some or all of the concepts discussed below can be practiced on many other types of work vehicles such as various other loaders, excavators, trenchers, and dozers, to name but a few examples.

Loader 200 includes frame 210 that supports a power system 220, the power system being capable of generating or otherwise providing power for operating various functions on the power machine. Power system 220 is shown in block diagram form but is located within the frame 210. Frame 210 also supports a work element in the form of a lift arm assembly 230 that is powered by the power system 220 and that can perform various work tasks. As loader 200 is a work vehicle, frame 210 also supports a traction system 240, which is also powered by power system 220 and can propel the power machine over a support surface. The lift arm assembly 230 in turn supports an implement interface 270, which includes an implement carrier 272 that can receive and secure various implements to the loader 200 for performing various work tasks and power couplers 274, to which an implement can be coupled for selectively providing power to an implement that might be connected to the loader. Power couplers 274 can provide sources of hydraulic or electric power or both. The loader 200 includes a cab 250 that defines an operator station 255 from which an operator can manipulate various control devices 260 to cause the power machine to perform various work functions. Cab 250 can be pivoted back about an axis that extends through mounts 254 to provide access to power system components as needed for maintenance and repair.

The operator station 255 includes an operator seat 258 and a plurality of operation input devices, including control levers 260 that an operator can manipulate to control various machine functions. Operator input devices can include buttons, switches, levers, sliders, pedals and the like that can be stand-alone devices such as hand operated levers or foot pedals or incorporated into hand grips or display panels, including programmable input devices. Actuation of operator input devices can generate signals in the form of electrical signals, hydraulic signals, and/or mechanical signals. Signals generated in response to operator input devices are provided to various components on the power machine for controlling various functions on the power machine. Among the functions that are controlled via operator input devices on power machine 200 include control of the tractive elements 219, the lift arm assembly 230, the implement carrier 272, and providing signals to any implement that may be operably coupled to the implement.

Loaders can include human-machine interfaces including display devices that are provided in the cab 250 to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided. Other power machines, such walk behind loaders may not have a cab nor an operator compartment, nor a seat. The operator position on such loaders is generally defined relative to a position where an operator is best suited to manipulate operator input devices.

Various power machines that can include and/or interacting with the embodiments discussed below can have various different frame components that support various work elements. The elements of frame 210 discussed herein are provided for illustrative purposes and frame 210 is not the only type of frame that a power machine on which the embodiments can be practiced can employ. Frame 210 of loader 200 includes an undercarriage or lower portion 211 of the frame and a mainframe or upper portion 212 of the frame that is supported by the undercarriage. The mainframe 212 of loader 200, in some embodiments is attached to the undercarriage 211 such as with fasteners or by welding the undercarriage to the mainframe. Alternatively, the mainframe and undercarriage can be integrally formed. Mainframe 212 includes a pair of upright portions 214A and 214B located on either side and toward the rear of the mainframe that support lift arm assembly 230 and to which the lift arm assembly 230 is pivotally attached. The lift arm assembly 230 is illustratively pinned to each of the upright portions 214A and 214B. The combination of mounting features on the upright portions 214A and 214B and the lift arm assembly 230 and mounting hardware (including pins used to pin the lift arm assembly to the mainframe 212) are collectively referred to as joints 216A and 216B (one is located on each of the upright portions 214) for the purposes of this discussion. Joints 216A and 216B are aligned along an axis 218 so that the lift arm assembly is capable of pivoting, as discussed below, with respect to the frame 210 about axis 218. Other power machines may not include upright portions on either side of the frame or may not have a lift arm assembly that is mountable to upright portions on either side and toward the rear of the frame. For example, some power machines may have a single arm, mounted to a single side of the power machine or to a front or rear end of the power machine. Other machines can have a plurality of work elements, including a plurality of lift arms, each of which is mounted to the machine in its own configuration. Frame 210 also supports a pair of tractive elements in the form of wheels 219A-D on either side of the loader 200.

The lift arm assembly 230 shown in FIGS. 2-3 is one example of many different types of lift arm assemblies that can be attached to a power machine such as loader 200 or other power machines on which embodiments of the present discussion can be practiced. The lift arm assembly 230 is what is known as a vertical lift arm, meaning that the lift arm assembly 230 is moveable (i.e., the lift arm assembly can be raised and lowered) under control of the loader 200 with respect to the frame 210 along a lift path 237 that forms a generally vertical path. Other lift arm assemblies can have different geometries and can be coupled to the frame of a loader in various ways to provide lift paths that differ from the radial path of lift arm assembly 230. For example, some lift paths on other loaders provide a radial lift path. Other lift arm assemblies can have an extendable or telescoping portion. Other power machines can have a plurality of lift arm assemblies attached to their frames, with each lift arm assembly being independent of the other(s). Unless specifically stated otherwise, none of the inventive concepts set forth in this discussion are limited by the type or number of lift arm assemblies that are coupled to a particular power machine.

The lift arm assembly 230 has a pair of lift arms 234 that are disposed on opposing sides of the frame 210. A first end 232A of each of the lift arms 234 is pivotally coupled to the power machine at joints 216 and a second end 232B of each of the lift arms is positioned forward of the frame 210 when in a lowered position as shown in FIG. 2. Joints 216 are located toward a rear of the loader 200 so that the lift arms extend along the sides of the frame 210. The lift path 237 is defined by the path of travel of the second end 232B of the lift arms 234 as the lift arm assembly 230 is moved between a minimum and maximum height.

Each of the lift arms 234 has a first portion 234A of each lift arm 234 is pivotally coupled to the frame 210 at one of the joints 216 and the second portion 234B extends from its connection to the first portion 234A to the second end 232B of the lift arm assembly 230. The lift arms 234 are each coupled to a cross member 236 that is attached to the first portions 234A. Cross member 236 provides increased structural stability to the lift arm assembly 230. A pair of actuators 238, which on loader 200 are hydraulic cylinders configured to receive pressurized fluid from power system 220, are pivotally coupled to both the frame 210 and the lift arms 234 at pivotable joints 238A and 238B, respectively, on either side of the loader 200. The actuators 238 are sometimes referred to individually and collectively as lift cylinders. Actuation (i.e., extension and retraction) of the actuators 238 cause the lift arm assembly 230 to pivot about joints 216 and thereby be raised and lowered along a fixed path illustrated by arrow 237. Each of a pair of control links 217 are pivotally mounted to the frame 210 and one of the lift arms 232 on either side of the frame 210. The control links 217 help to define the fixed lift path of the lift arm assembly 230.

Some lift arms, most notably lift arms on excavators but also possible on loaders, may have portions that are controllable to pivot with respect to another segment instead of moving in concert (i.e., along a pre-determined path) as is the case in the lift arm assembly 230 shown in FIG. 2. Some power machines have lift arm assemblies with a single lift arm, such as is known in excavators or even some loaders and other power machines. Other power machines can have a plurality of lift arm assemblies, each being independent of the other(s).

An implement interface 270 is provided proximal to a second end 232B of the lift arm assembly 234. The implement interface 270 includes an implement carrier 272 that is capable of accepting and securing a variety of different implements to the lift arm 230. Such implements have a complementary machine interface that is configured to be engaged with the implement carrier 272. The implement carrier 272 is pivotally mounted at the second end 232B of the arm 234. Implement carrier actuators 235 are operably coupled the lift arm assembly 230 and the implement carrier 272 and are operable to rotate the implement carrier with respect to the lift arm assembly. Implement carrier actuators 235 are illustratively hydraulic cylinders and often known as tilt cylinders.

By having an implement carrier capable of being attached to a plurality of different implements, changing from one implement to another can be accomplished with relative ease. For example, machines with implement carriers can provide an actuator between the implement carrier and the lift arm assembly, so that removing or attaching an implement does not involve removing or attaching an actuator from the implement or removing or attaching the implement from the lift arm assembly. The implement carrier 272 provides a mounting structure for easily attaching an implement to the lift arm (or other portion of a power machine) that a lift arm assembly without an implement carrier does not have.

Some power machines can have implements or implement like devices attached to it such as by being pinned to a lift arm with a tilt actuator also coupled directly to the implement or implement type structure. A common example of such an implement that is rotatably pinned to a lift arm is a bucket, with one or more tilt cylinders being attached to a bracket that is fixed directly onto the bucket such as by welding or with fasteners. Such a power machine does not have an implement carrier, but rather has a direct connection between a lift arm and an implement.

The implement interface 270 also includes an implement power source 274 available for connection to an implement on the lift arm assembly 230. The implement power source 274 includes pressurized hydraulic fluid port to which an implement can be removably coupled. The pressurized hydraulic fluid port selectively provides pressurized hydraulic fluid for powering one or more functions or actuators on an implement. The implement power source can also include an electrical power source for powering electrical actuators and/or an electronic controller on an implement. The implement power source 274 also exemplarily includes electrical conduits that are in communication with a data bus on the excavator 200 to allow communication between a controller on an implement and electronic devices on the loader 200.

Frame 210 supports and generally encloses the power system 220 so that the various components of the power system 220 are not visible in FIGS. 2-3. The arrangement of drive pumps, motors, and axles in power machine 200 is but one example of an arrangement of these components. As discussed above, power machine 200 is a skid-steer loader and thus tractive elements on each side of the power machine are controlled together via the output of a single hydraulic pump, either through a single drive motor as in power machine 200 or with individual drive motors. Various other configurations and combinations of hydraulic drive pumps and motors can be employed as may be advantageous.

The description of power machine 100 and loader 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on a loader such as track loader 200, unless otherwise noted or recited, the concepts discussed below are not intended to be limited in their application to the environments specifically described above.

Figure 4:
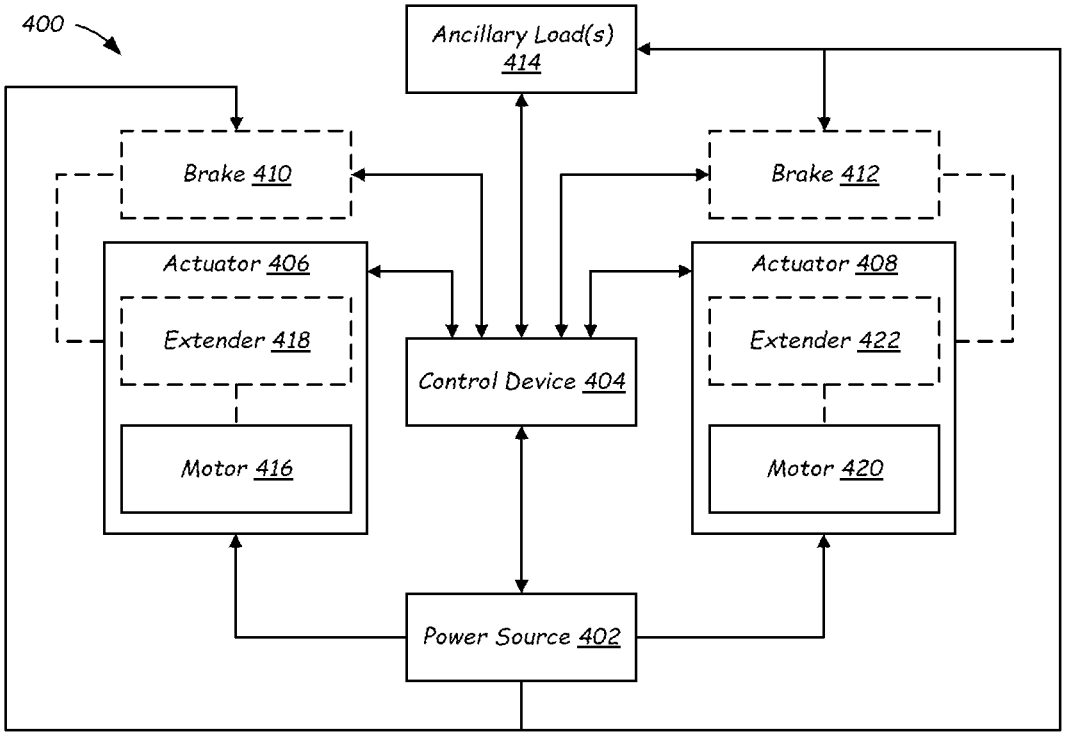
FIG. 4 is a block diagram schematic illustration of a power system of a power machine.

FIG. 4 shows a schematic illustration of a block diagram of a power machine 400, which can be any of a number of different types of power machines (e.g., wheeled or tracked skid-steer loaders), including any of the types generally discussed above. The power machine 400 can include a power source 402, a control device 404, electrical actuators 406, 408, brakes 410, 412, and ancillary load(s) 414. The power machine 400 can be an electrically powered power machine and thus the power source 402 can include an electrical power source such as, for example, a battery pack that includes one or more battery cells (e.g., lithium-ion batteries). In some embodiments, the power source 402 can include other electrical storage devices (e.g., a capacitor), and other power sources. In addition, the power machine 400 can, but need not, include an internal combustion engine that provides, via a generator, electrically power to the power source 402 (e.g., to charge one or more batteries of the electrical power source).

Generally, the control device 404 can be implemented in a variety of different ways. For example, the control device 404 can be implemented as known types of processor devices, (e.g., microcontrollers, field-programmable gate arrays, programmable logic controllers, logic gates, etc.), including as part of general or special purpose computers. In addition, the control device 404 can also include other computing components, including memory, inputs, output devices, etc. (not shown). In this regard, the control device 404 can be configured to implement some or all of the operations of the processes described herein, which can, as appropriate, be retrieved from memory. In some embodiments, the control device 404 can include multiple control devices (or modules) that can be integrated into a single component or arranged as multiple separate components. In some embodiments, the control device 404 can be part of a larger control system (e.g., the control system 160 of FIG. 1) and can accordingly include or be in electronic communication with a variety of control modules, including hub controllers, engine controllers, drive controllers, and so on.

In different embodiments, different types of actuators can be configured to operate under power from the power source 402, including electrical actuators configured as rotary actuators, linear actuators, and combinations thereof. As shown in FIG. 4, each electrical actuator 406, 408 can include a motor and an extender. Actuators 406 and 408 schematically represent various actuators on the power machine 400. For the purposes of illustration, the electrical actuator 406 can be a linear actuator that includes a motor 416 and an extender 418, while the electrical actuator 408 can similarly include a motor 420 and an extender 422. Each motor 416, 420 can drive extension (and retraction) of the respective extender 418, 422 to implement a particular functionality for the power machine 400. For example, the motor 416, which can include a stator that rotates a rotor, can drive extension of the extender 418 when the motor rotates in a first rotational direction, and can drive retraction of the extender 418 when the motor rotates in a second rotational direction opposite the first rotational direction. In this way, and depending on how the electrical actuator 406 is coupled to the components of the power machine 400, extension (and retraction) of the electrical actuator 406 can, for example, raise (or lower) a lift arm of the power machine 400, change an attitude an implement of the power machine 400 (e.g., a bucket), etc. Power machine 400 can also include rotary actuators without extenders (also represented in FIG. 4 by actuators 406 and 408) that are configured to drive the power machine 400 over terrain.

As mentioned above, each extender 418, 422 can move in a straight line (e.g., to implement a functionality for the power machine), and thus each electrical actuator 406, 408 can be an electrical linear actuator. In this case, for example, each extender 418, 422 can include a lead screw, a ball screw, or other known components for rotationally powered linear movement.

While the electrical actuators 406, 408 are each illustrated in FIG. 4 as including a respective extender 418, 422, in some embodiments, some electrical actuators can be implemented to lack an extender. In this case, each electrical actuator 406, 408 can include the respective motor 416, 420 to drive rotation of a particular component, rather than driving (linear) extension of a component (e.g., the extender). For example, the electrical actuator 406 can be the motor of a drive system of the power machine 400 to drive forward (and reverse) travel of the power machine 400. Although FIG. 4 shows two electrical actuators 406, 408, the power machine 400 can include other numbers of electrical actuators, such as, for example, one, two, three, four, five, six, etc. In some cases, the power machine 400 can include an electrical actuator that is a first lift actuator on a first lateral side of the power machine 400, an electrical actuator that is a second lift actuator on a second lateral side of the power machine 400, an electrical actuator that is a first tilt actuator that is on a first lateral side of the implement interface of the power machine 400, an electrical actuator that is a second tilt actuator that is on a second lateral side of the implement interface of the power machine 400, an electrical actuator that is a motor for a first drive system that is on (or otherwise powers) the first lateral side of the power machine 400, and an electrical actuator that is a motor for a second drive system that is on (or otherwise powers) the second lateral side of the power machine 400.

As also shown in FIG. 4, the brakes 410, 412 can be coupled to (e.g., included in) the respective electrical actuators 406, 408. For example, each brake 410, 412 can be a mechanical brake that includes a mechanical stop that can be moved into engagement to block further movement of the relevant extender 418, 422 (or, in some cases, the relevant motor 416, 420) in one or more directions, and can be moved into disengagement to allow movement of the extenders 418, 422 (e.g., to move in the extension or retraction directions). In some cases, a mechanical brake can include an arm that contacts the lead screw of the extender 418, 422 (if a particular actuator has an extender) to block further movement of the extender 418, 422, and that disengages with the lead screw of the extender 418, 422 to allow (further) movement of the extender 418, 422. In some embodiments, one or more of the mechanical brakes 410, 412 can be an electrically powered brake (i.e., can include one or more electrical actuators). For actuators such as a drive motor that do not have an extender, a brake can engage any acceptable moving mechanism to selectively prevent movement of the motor.

As shown in FIG. 4, the power source 402 can be electrically connected to the control device 404, the electrical actuators 406, 408, the mechanical brakes 410, 412, and the ancillary load(s) 414. Thus, the power source 402 can provide power to each motor 416, 420 to drive movement (e.g., extension and retraction) of the respective extenders 418, 422, to the control device 404, to each mechanical brake 410, 412, to each of the ancillary load(s) 414, etc. As shown in FIG. 4, the control device 404 can be in electrical communication with the power source 402, the actuators 406, 408, the mechanical brakes 410, 412, and the ancillary load(s) 414, and can adjust (e.g., limit) the power delivered to or consumed by each of these electrical loads (or others). For example, as appropriate, the control device 404 can adjust (e.g., decrease) the power delivered to each of these electrical loads by adjusting (e.g., decreasing) the current that can be consumed by at least some of these electrical loads. In some cases, an actual command for movement of an actuator can be scaled downward from a commanded movement of the actuator according to an operator input, so that the actuator will consume less power than commanded by the operator input. For example, an operator may command a particular travel speed for a power machine and the actual commanded speed for the relevant drive motor(s) by the control device 404 may be comparatively reduced (e.g., based on a predetermined derating of the motor(s)). As another example, the control device 404 can adjust the current delivered to an electrical load by adjusting a driving signal delivered to a current source (e.g., a voltage controlled current source) that can be electrically connected to the electrical load (e.g., integrated within a power electronics driver board, such as a motor driver) to deliver current to the electrical load. For example, the current source can include one or more field-effect transistors, and the driving signal can be the voltage applied to the one or more field-effect transistors to adjust the current delivered and thus the power delivered to the electrical load (e.g., the motor).

In some embodiments, similarly to each of the electrical loads of the power machine 400, the electrical power source of the power source 402 can include (or can be otherwise electrically connected to) a current source (e.g., a power electronics board) that adjusts (e.g., and can restrict) the amount of power to be delivered to the electrical loads of the power machine 400. In this case, the control device 404 can adjust the driving signal to the electrical power source to adjust the total amount of current and thus the amount of power delivered to the electrical loads of the power machine 400. More particularly, the control device 404 can adjust the output from the electrical power source to regulate the torque, position, direction, and speed of the motor.

As a specific example of the preceding general discussion of power management modes, the control device 404 can be configured to control operation of a power system (e.g., the actuators 406, 408, and the ancillary loads 414, or the power source 402) according to relevant operational parameters of a selected power management mode. In some embodiments, the control device 404 can advantageously ensure that the power delivered to any particular electrical load, or the total power provided by the electrical power source, does not exceed a particular value (e.g., as defined by the power management mode). In this way, for example, the power machine 400 can conserve the electrical power of the electrical power source to prolong run-time of the power machine 400.

In some embodiments, the control device 404 can be configured to determine a present (i.e., temporally current) power usage of one or more actuators or other electrical loads, or a present power delivery from a power source. In some cases, a present power usage or delivery can be measured instantaneously. In some cases, a present power usage or delivery can be measured as an average power delivery over a recent time interval (e.g., a preceding 2 seconds). Thus, for example, the control device 404 can determine a present power usage for each electrical load of the power machine 400, or can determine a present power delivery from the electrical power source of the power source 402.

In some cases, each electrical load of the power machine, and the power source 402 can include or can otherwise be electrically connected to a current sensor to determine the current being provided to (or by) the particular electrical component, and a voltage being provided to (or by) the particular electrical component can also be determined (e.g., based on voltage sensor or a fixed voltage provided by the power source 402). In this way, for example, the control device 404 can receive information about a present voltage and a present current that is delivered to each individual electrical load, or about the present voltage and current that is supplied by the electrical power source of the power machine 400 in total and can thereby determine a present power usage for relevant (e.g., all) electrical loads and for the electrical power source of the power machine 400.

In some embodiments, the control device 404 can determine a present power usage for the electrical power source of the power machine 400 by adding the present power usage for each relevant electrical load of the power machine 400. The power can be determined by multiplying current and voltage. Alternatively, the power can be determined by multiplying the torque and speed of a motor. In certain circumstances, it may be advantageous to use either of these known methods. In other cases, the control device 404 can determine a present power usage of the electrical power source of the power machine 400 only by determining the power delivered by the electrical power source. For example, the control device 404 can receive a present value for current delivered by the electrical power source 402 and, based on the voltage of the electrical power source 402, can then determine a total present power usage for the electrical power source. In some cases, the control device 404 can assume a substantially constant voltage for the electrical power source, and determine the present power usage of the electrical power source by using the constant voltage and the present current value.

Regardless of the measurement approach (e.g., as describe above), determining the present electrical power usage for the power machine 400 can be helpful for ensuring that the collective power delivered by the electrical power source does not exceed a threshold (e.g., a range, a value, etc.), and, in some cases, that the power delivered to each electrical load also does not exceed a corresponding threshold. In this way, for example, the control device 404 can prolong the total run-time available to the power machine 400 by conserving the power of the electrical power source when, for example, the received power to an electrical load of the power machine 400 exceeds a threshold value.

In some embodiments, the electrical power source 402 can include or can be electrically connected to a sensor to sense a present remaining energy of the electrical power source. In some cases, for example, a voltage sensor can sense the voltage of the electrical power source, which can be indicative of the present remaining energy left within the electrical power source (e.g., because the voltage of the electrical power source can be related to the present remaining energy within the electrical power source). Any suitable means for sensing the remaining energy of the electrical power source can be used, including an accounting of how much current is supplied by the energy storage device over time.

As also noted above, in some embodiments, the power machine 400 can include one or more ancillary loads 414 (i.e., loads not associated with providing tractive or work-group power). For example, the ancillary loads 414 can each be an electrical load that receives power from the electrical power source of the power source 402. For example, an ancillary load 414 can include a climate control system (e.g., including a heater, an air-conditioning system, a fan, etc.), a sound system (e.g., a speaker, a radio, etc.), etc. In some cases, ancillary loads 414 may be treated with lower priority according to certain power management modes. For example, when the power machine 400 operates in certain power management modes, the control device 404 can decrease the power delivered to one or more of the ancillary loads 414, which can include stopping power delivery to some or all of the ancillary loads 414. In this way, for example, the run-time of the power machine 400 can be prolonged by limiting the power delivery to the ancillary loads 414 (e.g., to otherwise prioritize other electrical loads of the power machine including, for example, the electrical actuators 406, 408 and drive motors discussed above).

In some embodiments, the power machine 400 can include one or more sensors that can sense various aspects of the power machine 400. For example, the power machine 400 can include a torque sensor for each electrical actuator to sense a current torque of each motor of the respective electrical actuator. In some cases, the torque sensor can be the same as the current sensor electrically connected to the electrical actuator (e.g., because current is related to the torque). As another example, the power machine 400 can include a position sensor for each extender of each electrical actuator (as appropriate) to sense a present extension amount for the extender of each electrical actuator (e.g., relative to the housing of the electrical actuator). In some cases, this can be a hall-effect sensor, a rotary encoder for the motor (e.g., which can be used to determine the extension amount of actuators with extenders), an optical sensor, etc. As yet another example, the power machine 400 can include an angle sensor for each pivotable joint of the lift arm of the power machine 400 to determine a current orientation of the lift arm (and implement coupled thereto). As yet another example, the power machine 400 can include a speed sensor or an acceleration sensor (e.g., an accelerometer) to respectively determine a current speed or a current acceleration of the entire power machine 400 or of a component thereof. As still yet another example, the power machine 400 can include an inclinometer (e.g., an accelerometer) that can sense the current attitude of a mainframe of the power machine 400 with respect to gravity.

Each of these measured values (or others) can inform a present operational condition of the power machine 400, which can be used by the control device 404, including as described below, to select a particular power management mode. For example, based on determining that present operational conditions indicate present or planned execution of a particular task, the control device 404 can select a power management mode accordingly.

As also generally noted above, in some embodiments, the control device 404 can cause a fluctuating movement of a work element (e.g., a bucket or other implement), including by commanding one or more of the electrical actuators 406, 408 to extend and retract the corresponding extender 418, 422 over multiple cycles. For example, the control device 404 can cause the extender 418 to extend a first particular amount over a first period of time, can cause the extender 418 to retract a second particular amount over a second period of time, can cause the extender 418 to extend a particular amount over a third period of time, and so on. In some embodiments, the first, second, third, etc., extension or retraction amounts can be the same, and the first, second, third, etc., periods of time can be the same. In this way, for example, a bucket or other component coupled to the extender 418 can be caused to execute a relatively rapid fluctuating movement that follows the movement of the extender 418, with the component alternately moving (e.g., oscillating) to either side a particular reference orientation. In some configurations, rather than moving about a particular common position of the extender 418, the extender 418 can move about a positional range, to, for example, accommodate for drifting of the component.

As noted above, in some configurations, the extender 418 extending the first particular amount and then subsequently retracting the extender 418 the second particular amount (or vice versa) can define a cycle, with the control device 402 causing the extender 418 to extend and retract over multiple cycles. In some cases, successive cycles can be similar, including with the same (or similar) amplitudes, frequencies, etc. However, successive cycles need not be similar (i.e., can be irregular over time). For example, an extension amount of the extender 418 between cycles can be different, an extension time for the extender 418 between cycles can be different, a retraction amount of the extender 418 between cycles can be different, a retraction time for the extender 418 between cycles can be different, etc. In some cases, the extension and retraction of the extender 418 for one or more cycles can be advantageous for particular tasks. For example, the extender 418 can be coupled to a bucket, which can shake the bucket and thus dislodge material trapped in the bucket. Further, in some cases, an irregular fluctuation can beneficially result in an implement effectively shaking while performing a cutting operation (i.e., while actively using a cutting edge on a bucket to engage soil or other material) or when moving toward a particular orientation (e.g., shaking while digging, or shaking while dumping toward a fully rolled out orientation). The optimal amplitude and frequency of shaking movements for these different tasks may be different, and an automatic recognition of each condition or having an operator input to command the different fluctuating movements is particularly advantageous.

As generally noted above, in some embodiments, the electrical actuators 406, 408 can be electrical tilt actuators that are coupled to an implement (e.g., a bucket). In this case, the control device 404 can extend and retract each extender 418, 422 according to the process described above (e.g., extending and retracting a particular amount over a particular amount of time, over a number of cycles, etc.) to cause a fluctuating tilting movement. . . . In this way, for example, including when the implement is a bucket, material supported by the implement can more easily be deposited at a target location (e.g., with the fluctuating movement helping to dislodge material trapped in the bucket). In some cases, shaking of the bucket can be more precise (e.g., more available ways to shake the implement due to variations in the cycles), and can be faster when utilizing electrical actuators as compared to hydraulic actuators (e.g., because power can be delivered to electrical actuators more quickly than hydraulic actuators).

In some embodiments, the control device 404 can cause an electrical actuator to shake a component coupled thereto based on an operator input. For example, the power machine 400 can include an operator input device (not shown), which can be an actuatable button. In this case, the control device 404 can cause the actuator to extend and retract over multiple cycles while the operator input device is actuated (e.g., pressed), or for a particular amount of time after the control device 404 receives the operator input (e.g., indicative of the operator input device having been depressed). For example, an operator may press and hold an input button to cause a bucket to shake over a particular desired time, or an operator may press an input button to initiate shaking of a bucket for a predefined (or automatically determined) time, or an operator may press an input button to initiate shaking of a bucket and then press the input button again to cease the shaking of the bucket. The particular number, amplitude and frequency of the cycles can be predetermined or alterable by an operator. In some cases, the control device can be altered during a set up routine to set the various parameters. Alternatively, some embodiments include a variable input device such as a thumb switch or other suitable input device that the operator can manipulate to change the intensity of the fluctuation movements. The intensity changes can be accomplished by changing either the amplitude of the cycles (in one direction or both) and the frequency of the cycles, or both, in response to a change in the variable operator input.

In some embodiments, the control device 404 can cause an electrical actuator to shake a component coupled thereto based on a sensed operational condition of the power machine. For example, fluctuating movement of a bucket can be automatically implemented based on a present operational mode of the power machine (e.g., a digging mode), based on a sensed loading of a particular component (e.g., a suddenly and substantially increased load during a digging operation), based on an orientation of a power machine component (e.g., when the lift arm is at a particular height or orientation), or based on a combination of these factors (e.g., when the power machine is operating in a particular mode and a particular corresponding loading or orientation is detected).

Figure 5:
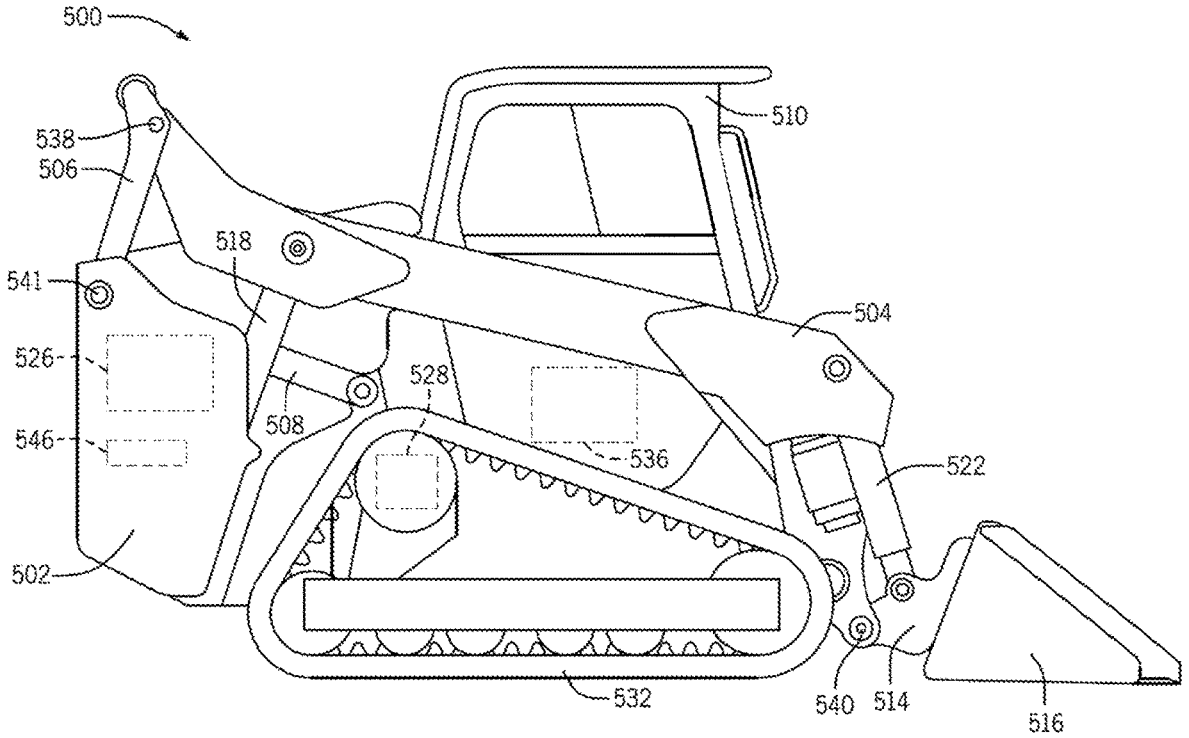
FIG. 5 is a side isometric view of an electrically powered power machine with the lift arm in a fully lowered position.

FIG. 5 shows a side isometric view of an electrically powered power machine 500 with a lift arm in a fully lowered position, which can be a specific implementation of the power machine 200, the power machine 400, etc. As shown in FIG. 5, the power machine 500 can include a main frame 502, a lift arm 504 coupled to the main frame via a follower link 506, a driver link 508 pivotally coupled to the lift arm 504 and the main frame 502, an operator enclosure 510 (e.g., a cab, as shown), an implement interface 514 coupled to an end of the lift arm 504, an implement 516 (e.g., a bucket as shown) coupled to the implement interface 514, an electrical lift actuator 518, an electrical tilt actuators 522, an electrical power source 526, a drive system 528 (e.g., including an electrical drive motor), a traction devices 532 (e.g., an endless track, as shown), and a climate control system 536 (e.g., as generally representative of an ancillary electrical load). As generally noted above, similar other components can be provided symmetrically (or otherwise) on an opposing lateral side of the power machine 500, including another electrical lift actuator, another electrical tilt actuator, etc.

In some cases, the electrical power source 526 can be implemented in a similar manner as the previously described power sources (e.g., the power source 402). Thus, the electrical power source 526 can include a battery pack including one or more batteries. In general, the electrical power source 526 can supply power to some or all of the electrical loads of the power machine 500. For example, the electrical power source 526 can provide power to the lift electrical actuator 518, the electrical tilt actuator 522, the drive system 528, the climate control system 536, etc.

The power machine 500 can also include a control device 546 that can be in communication with the power source 526 and some (or all) of the electrical loads of the power machine 500, as appropriate. For example, the control device 546 can be in communication with the lift electrical actuator 518, the implement electrical actuator 522, the drive system 528, the climate control system 536, etc. In this way, the control device 546 can control operation of these components, or related other systems, to adjust how power is routed to each of these electrical loads (e.g., depending on the criteria defined by the particular power management mode) and, correspondingly, how much power from the power source 526 is consumed during a given operational interval.

Figure 6:
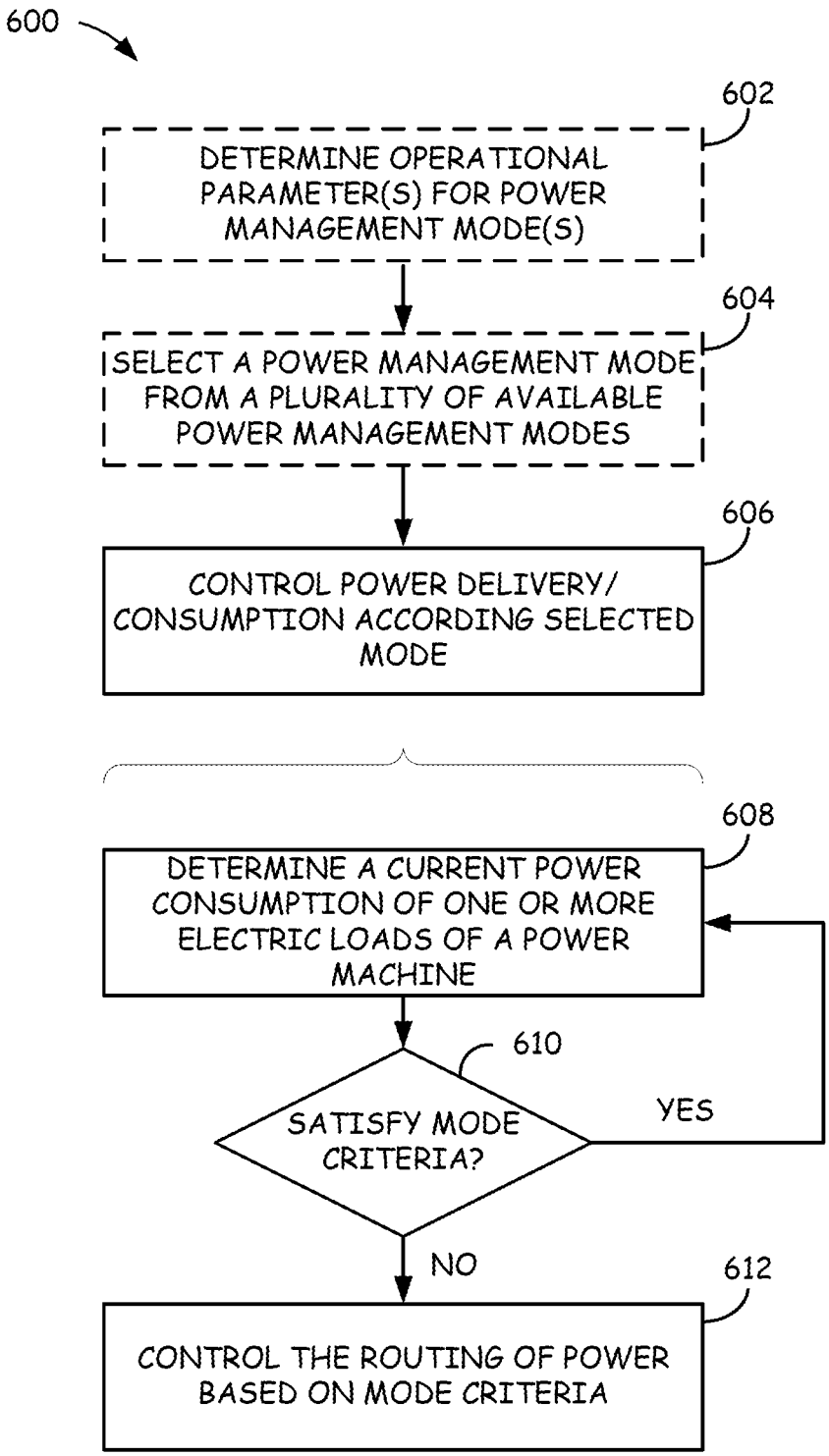
FIGS. 6 and 7 show flowcharts of processes for operating an electrically powered power machine.

FIG. 6 shows a flowchart of a process 600 for operating an electrically powered power machine, which can be implemented using one or more computing devices (e.g., a control device including the control device 404, the control device 546, etc.). In addition, the process 600 can be implemented for any of the power machines described herein, appropriate, such as, for example, the power machine 400, the electrically powered power machine 500, etc.

At block 602, the process 600 can include a computing device determining one or more operational parameters for routing power to the one or more electrical loads of the power machine for each of a plurality of power management modes. In some cases, there can be a plurality of power management modes with each power management mode being different from the others. Thus, for example, execution of the process 600 can correspond to operation of a power machine with different profiles of power consumption for a given set of operator commands.

In some cases, there can be a power management mode associated with each of a plurality of different implements, including because different implements can require different power delivery to complete a particular work task (e.g., digging). For example, a power management mode associated with a first type of implement (e.g., an auger, a mower, etc.) can allow for more power from the electrical power source of the power machine to be directed to the implement than a power management mode associated with a second type of implement (e.g., a bucket, a grader attachment, etc.) at least because the first type of implement requires additional movement to complete the particular task as compared to the second type of implement. As another example, larger implements (e.g., of the same type) typically require more power to complete the work task, and thus there can be a first power management mode associated with a first implement of a first type and a second power management mode associated with a second implement of the first type that is larger than the first implement.

In some embodiments, there can be a power management mode associated with each of a plurality of different work mode (e.g., a digging mode, a grading mode, a mowing mode, a lifting mode, a drilling mode, a loaded mode, an unloaded mode, a roading mode, etc.). For example, a power management mode for digging can allow for more total power usage than a power management mode for drilling (using an auger), including because the power machine when digging can typically require more power than the power machine when drilling (e.g., because the power machine is powering the drive system to assist with the digging operation, whereas the drive system is not being engaged to any significant extent during a drilling operation). In these ways, for example, a power management mode can be specifically tailored to provide optimal performance for particular work operations, in addition (or as an alternative) to particular implements, etc.

In some cases, the one or more operational parameters determined at block 602 can be different thresholds (e.g., set threshold values or ranges) related to power consumption. For example, the one or more operational parameters can include thresholds for a measured power consumption of one or more electrical loads of the power machine (e.g., including one or more electrical actuators of the power machine), a measured power output of the electrical power source of the power machine, a total electrical power consumption of a power machine, etc. In some configurations, a power threshold can be an average power consumption value over a predetermined interval of time, and a measured power output (or consumption) can be determined as an average measure power output over a predetermined time interval.

In some cases, the one or more operational parameters can include logical conditions, corresponding to execution of particular operations by a control device to manage power routing or consumption (e.g., to prioritize different functionality of the power machine) depending on the value of a relevant input, state, or other factor. For example, an operational parameter can indicate that power delivery to a particular actuator or other electrical load should be reduced based on the occurrence of a particular condition (e.g., the detection of a particular state of the power machine or a component thereof). In some embodiments, there can be multiple logical conditions associated with the same operational parameter.

In some embodiments, the one or more operational parameters can include a priority for power delivery for one or more electrical loads of the power machine. For example, under some power management modes, a control device can operate to maintain power delivery or to cause a lower decrease in power delivery (e.g., as a percentage of measured power delivery) for higher priority electrical loads as compared with electrical loads that have a lower priority. For example, if a computing device determines that the power consumption demanded from a battery pack is greater than a threshold value, then the computing device can decrease by a greater percentage (or absolute value) the actual power delivery to a first electrical load that has a lower priority (e.g., a climate control system) than for a second electrical load that has a higher priority (e.g., an electrical lift actuator). In this way, important electrical loads (e.g., electrical drive and workgroup actuators) of the power machine can be prioritized to receive power over less important electrical loads, such as, for example, auxiliary electrical loads (e.g., a radio, a climate control system, etc.). In some cases, it may be advantageous to prioritize the delivery of power to a particular actuator to accomplish a given task without regard to the overall power consumption of the power machine over time. For example, providing all or substantially all (or at least more power than might be allocated during a typical mode) to the drive system may allow the vehicle to push a large load or move up a steep incline. In some embodiments, such a surge of power may be allowed for a short period of time and may require a specific input from an operator (e.g., to temporarily activate a relevant power management mode).

In some embodiments, determining operational parameters at block 602 can include storing or retrieving the operational parameters in or from memory. For example, a control device can access a memory of a power machine to retrieve operational parameters for one or more particular power management modes, to inform control of power delivery according to a selected one of the power management modes. In some case, operational parameters can be stored in memory during manufacture or upgrade of a power machine, including as may provide a set of default power management modes (e.g., maximum power, medium power, and low power modes). In some cases, operational parameters can be entered into memory by operators via manual (or other) operator inputs, including as may allow particular operators to customize particular power management modes. In some cases, operational parameters for power management modes can be determined automatically, including as based on analysis of runtime operations of a power machine, operator behavior, or other factors.

At block 604, the process 600 can include a computing device selecting a power management mode from a plurality of available power management modes. In some cases, selecting a power management mode can be based on an operator input (e.g., from an operator engaging with a touchscreen or other input device). In some cases, a computing device can determine select a power management mode based on one or more other input parameters, including as based on one or more present operational conditions of the power machine. For example, one or more operational conditions upon which selection of a power management mode can be based can include an orientation of the lift arm, an orientation of another work element (e.g., an implement), a commanded movement of the lift arm, a commanded movement of another the work element (e.g., an implement), a load supported by a work element, a present power capacity of the electrical power source (e.g., as a percentage of a maximum possible power capacity of the electrical power source), etc. For example, a computing device can determine that a load supported by a work element exceeds a threshold weight, and can select a particular power management mode based on this determination (e.g., to provide more power to electrical lift actuators), or can determine that a power machine is or is likely to be executing particular work operations (e.g., roading, digging, back-dragging, etc.) and can select a particular power management mode on that basis. As another example, the computing device can switch to a low power mode to conserve power by reducing the power available to some or all of the loads on the machine.

At block 606, the process 600 can include a computing device controlling power delivery or power consumption according to the selected power management mode. For example, a computing device can sometimes cause a reduced delivery of power to particular actuators (or other electrical loads) according to a selected power management mode, including to prioritize power delivery to one or more other actuators (or other electrical loads) or to ensure that an electrical power source can continue to power operations of the power machine for sufficient additional time. In some cases, a computing device can derate a particular actuator (e.g., a drive motor) so that a present maximum operational speed of the actuator is reduced relative to a maximum possible speed of the actuator. In some cases, a computing device can otherwise modify input commands (e.g., operator commands for position, speed, torque, etc.) so that appropriate operation of an actuator may proceed, but with a lower power consumption than would otherwise correspond to those same input commands.

As part of operations at block 606, in some cases, the process 600 can include at block 608 a computing device determining a present power consumption of one or more electrical loads of the power machine. For example, determining a present power consumption can include a computing device determining the present power consumption of each electrical load of the power machine (e.g., by sensing a present voltage and present current consumption for each electrical load to determine the present power consumption). In some cases, determining a present power consumption can include determining a total present power consumption for the entire power machine by summing each of multiple determined present power consumptions for electrical loads of the power machine. In some embodiments, determining a present power consumption can include a computing device determining a present power output of an electrical power source (e.g., by sensing a present voltage and a present current output from the electrical power source to determine the present power output of the electrical power source).

At block 610, the process 600 can then include a computing device determining whether or not the present power consumption (or present power output from the electrical power source) satisfies a particular criteria specified by the one or more operational parameters of the selected power management mode. In some cases, this can include a computing device determining whether the present power usage for one or more electrical loads or the power machine as a whole have exceeded a threshold value or determining whether the present power output from an electrical power source has exceeded a threshold value. At block 610, a computing device determines whether the present power usage satisfies a mode criteria (e.g., has exceed a relevant threshold). If a computing device determines that the present power usage (or present power output) has not satisfied the criteria, then the process 600 can proceed to block 612. Otherwise, if a computing device determines that the present power usage (or present power output) has satisfied the criteria (e.g., has not exceeded a relevant threshold), then the process 600 can proceed back to the block 608 to redetermine a present power consumption (or present power output).

At block 612, the process 600 can include a computing device controlling the routing of power to one or more electrical loads (e.g., one or more electrical actuators) of a power machine according to the selected power management mode. For example, this can include stopping the routing of power from the electrical power source to one or more electrical loads (e.g., ancillary electrical loads, such as, for example, a speaker system, a climate control system, a radio, etc.). As another example, operations at block 612 can include reducing the power consumption for one or more select electrical loads of the power machine (e.g., a single electrical load, multiple electrical loads, etc.). As a more specific example, this can include reducing the power consumption for each electrical drive actuator that provides power to a tractive device of the power machine (e.g., an endless track, a wheel, etc.). In some cases, as also noted above, reducing power consumption for some electrical loads of the power machine may coincide with not actively reducing power consumption for other electrical loads of the power machine (or with reducing that consumption less substantially). For example, selective reduction in power consumption can be based on a priority ranking of the electrical loads according to the selected power management mode. For example, some operations at block 612 can include reducing power consumption of an ancillary electrical load or an electrical drive actuator, while not actively reducing the power consumption of an electrical lift actuator or an electrical tilt actuator (other than as commanded by an operator). In other words, in various embodiments, different strategies may be incorporated to reduce the overall electrical load of the power machine.

In some embodiments, reducing the power consumption of the one or more electrical actuators of the power machine can include a computing device incrementally decreasing the power consumption of the one or more electrical actuators until the present power consumption of the one or more electrical actuators is less than or equal to a threshold value. In this way, large changes in power delivery to actuators can be avoided (e.g., preventing jerking movements of the lift arm), while still aiming to decrease total power usage of the power machine. Correspondingly, as also discussed above, certain mode criteria can be evaluated at 610 based on averaged rather than instantaneous values, as may also help to provide smoother operation from the perspective of an operator.

In some embodiments, block 612 can include a computing device locking an actuator. For example, a computing device can cause a mechanical brake of an electrical actuator to lock the extender of the electrical actuator to lock the extender in place. In this way, the electrical actuator may not actively consume power, which can thereby reduce overall power consumption, as appropriate, under the operational parameters of the selected power management mode.

In some cases, block 612 can include controlling a routing of power to an electrical actuator that is below a commanded power delivery to the electrical actuator (e.g., as commanded by an operator input device, such as, for example, a joystick). In this way, a computing device can ensure that a total power consumption for the entire power machine is below a particular value, even when commanded by an operator to increase power consumption and can thereby prolong the run-time of the power machine between charges. For example, a control device can cause an electrical drive actuator to receive less power than is currently being commanded by an operator input of the power machine, when, for example, the power machine is operating according to the power management mode that limits the power delivered to the electrical drive actuator (e.g., a power management mode that prioritizes power for workgroup operations). In some embodiments, block 612 can include preserving certain operational characteristics of a power machine even while reducing power consumption. For example, a computing device can control drive actuators to provide commanded acceleration rates while limiting maximum speed to below a particular speed threshold (e.g., corresponding to a particular power threshold).

In some embodiments, the process 600 can proceed back to the block 606 to select a different power management mode. For example, a computing device can periodically evaluate the one or more operational conditions of the power machine (e.g., relative to logical conditions) to select a different power management mode from the plurality of available power management modes. As another example, as also noted above, an operator can provide an input indicating a desired power management mode via any variety of known operator input devices, and a control device can then select a power management mode on that basis.

In some embodiments, during the process 600 (or at other times), a computing device can track the amount of time the power machine is operating under each different power management mode. In this way, the total time can be used to further determine the operational parameters of a corresponding power management mode. For example, if during a digging power management mode, a computing device determines that the amount of time roading (e.g., driving to a location, such as, for example, a dumping location) is higher than expected, then the power threshold during roading can be decreased to conserve additional power, because drive actuators can consume a relatively high amount of power.

Figure 7:
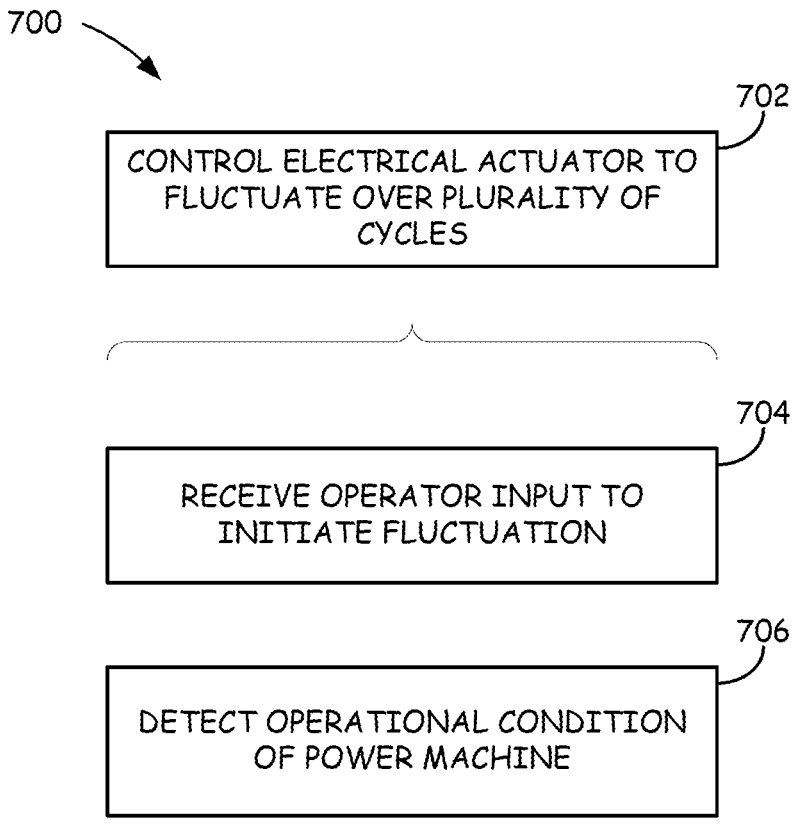

FIG. 7 shows a flowchart of a process 700 for operating an electrically powered power machine, which can be implemented using one or more computing devices (e.g., a control device including the control device 404, the control device 546, etc.). In addition, the process 700 can be implemented for any of the power machines described herein, appropriate, such as, for example, the power machine 400, the electrically powered power machine 500, etc.

At 702, the process 700 can include controlling one or more electrical actuators to cause the actuator(s) to fluctuate over a plurality of cycles. For example, as also discussed above, a control device can be configured to automatically control an electrical tilt actuator to cause an attitude of a bucket or other implement to fluctuate relative to a reference point and thereby shake the bucket to improve dumping, digging, or other operations. In some embodiments, operations at block 702 can be based on, at 704, receiving an operator input to initiate or otherwise control the fluctuation. In some embodiments, operations at block 702 can be based on, at 706, detecting a particular operational condition of the power machine. Thus, for example, a variety of automatic or operator-controlled fluctuations of an implement or other work element can be executed, including as may automatically (or otherwise) help an implement to cut through dense material, remove sticky material from an implement, improve overall machine loading or balance, etc.

Thus, some embodiments of the disclosure can provide improved power management of power machines to prolong the total run-time of power machines. For example, in some implementations, selection of a power management mode can help to increase total operational time for an electrically powered power machine between charges or can help to ensure that power is selectively routed to particular actuators according to appropriate prioritization. Further, some embodiments of the disclosure can provide improved control of implements or other work elements, including via manually or automatically controlled fluctuation of the work elements. For example, in some implementations, a control device can command fluctuating movement to shake material free from a bucket and thereby generally improve digging and dumping operations.

As noted above, a power machine may be configured to function in accordance with one or more power management modes, which can adjust how power is routed to various electrical loads (e.g., depending on the criteria defined by the particular power management mode) and, correspondingly, how much power from a power source is consumed during a given operational interval. As described above, the power management modes may generally relate to decreasing power delivery or power consumption. However, in some embodiments, a power machine may be configured to function in accordance with a power management mode that generally relates to increasing power delivery or power consumption, referred to generally herein as a power burst mode.

As noted above, in some cases, it may be advantageous to prioritize the delivery of power to a particular actuator to accomplish a given task without regard to the overall power consumption of the power machine over time. Accordingly, a power burst mode can be implemented based on a received request (e.g., a received signal as initiated by an operator input, or a signal from an automated power module), to selectively and temporarily provide increased power to one or more actuators. Generally, in addition to being based on a power mode request, initiation of power burst mode may be dependent on appropriate burst mode criteria or conditions being met. For example, operational conditions (e.g., operating or ambient temperature, battery charge, power demand, power machine orientation, etc.) can be compared to particular thresholds (e.g., a maximum permitted temperature of the one or more actuators, actuator driver/controllers, battery, etc., a no-burst floor value for battery charge, a particular range of attitude for a power machine along a particular axis, elapsed time since last permitted power burst mode, among other thresholds which will be discussed in more detail below) to determine whether a power burst mode can be implemented.

When a power burst mode is initiated, a control device of a power machine can increase power delivery to one or more actuators (e.g., workgroup or drive actuators). The increased power delivery (and consumption) for a particular actuator (or group of actuators) may temporarily exceed a power threshold of the actuator (or group) when the power burst mode is requested or initiated (in some embodiments). Thus, for example, although normal operation of a particular actuator may be limited in a particular power management mode to a maximum power threshold, operation in a power burst mode may temporarily override such a maximum power threshold with corresponding benefits for operator control and overall power machine functionality.

As one example, providing increased power (e.g., all or substantially all of power available) to a drive system may allow a vehicle to push through a pile or move up a steep incline, as may require substantially more power than average operations but only for a short amount of time. As another example, an operator of the power machine may sometimes need increased power to avoid obstacles more easily or to attain or maintain appropriate speeds over short distances. In yet other embodiments, a control device of a power machine may normally limit operation of an electrical actuator to a maximum rated power plus or minus a safety threshold (e.g., limiting power delivery to 75% of a rated power for the electrical actuator). When burst mode is requested and the prerequisite burst mode conditions are met, the control device may allow the one or more electrical actuators to operate up to their respective power capacity rating (e.g., enabling power delivery up to 100% of a rated power for the one or more electrical actuators), such as, e.g., when a user input is received indicative of an input request exceeding the safety threshold. In some specific embodiments, operator control input mapping may be re-mapped when switching between respective modes (e.g., a normal operation mode and a power burst mode). That is, in a normal operation mode, a 100% throttle input associated with one electrical actuator may result in power delivery to the electrical actuator (or power draw of the electrical actuator) that is the rated power capacity minus the safety threshold. Accordingly, in the power burst mode, the same 100% throttle input may result in the control device delivering or allowing the electrical actuator to draw 100% of its rated power capacity.

In different embodiments, different profiles of power increases can be provided, including as can be adapted to different work operations or actuators. In some cases, power to an actuator can be increased continuously to one or more target levels, can be maintained at or above (or below) one or more threshold levels, or can be decreased continuously to standard rated power delivery after a predetermined amount of time. In some embodiments, increased power delivery may be provided continuously for no more than a predetermined period of time (e.g., with a predetermined interval between successive power burst events, as further discussed below). In some embodiments, operation in power burst mode may include providing increases in total power provided by a power source to all relevant powered systems, or may include providing increases in a proportion of power routed from a power source to one or more actuators as compared to total power consumption from the power source. For example, a dig-and-dump burst mode, may route additional power to drive actuators when driving a working machine into a pile of material, and subsequently re-route additional power away from the drive actuators to the lift actuators (or tilt actuators) to overcome a break-out force of the material in the pile. After break-out, additional power may again be re-routed to the drive actuators from the lift actuators and subsequently to the lift actuators to facilitate lifting the load to dump height. The dig-and-dump burst mode may be repeated based upon operator input or continued operation characteristics of the power machine, and subject to the various threshold operational conditions (discussed in more detail herein).

In some embodiments, as generally noted above, a power burst mode may be initiated based on receipt of a specific input from an operator. For example, an operator may press a button or flip a switch in an operator station to request temporary operation in a power burst mode, or execution of a power burst event according to a power burst mode (i.e., execution of a particular temporary increase in power according to relevant operational parameter(s) of a power burst mode). In some embodiments, an operator input device can be configured to receive a first control input for an actuator relative to a first degree of freedom (e.g., via a joystick pivot about a first axis) to generally command operation of the actuator (e.g., to command forward/reverse or extension/retraction movement). Further, the operator input device can be configured to receive a second control input for the actuator relative to a second degree of freedom different from the first degree of freedom (e.g., via a button input on the joystick) to request operation in a power burst mode or execution of a power burst event. In some embodiments, a first operator input device can be used for general control of an actuator and a second, different operator input device can be used to request a power burst mode or event for the actuator. In some embodiments, a request for operation in a power burst mode or execution of a power burst event can be provided automatically (e.g., by an automatic control system in response to one or more sensed operating conditions of a power machine). For example, a 100% operator command on one or more user input devices in conjunction with meeting the prerequisite operational conditions.

As also noted above, increases in power during operation in a power burst mode are generally temporary increases in power. Accordingly, power burst events can generally be ended in response to relevant termination conditions. For example, some power burst events can be ended after a predetermined interval of time. As another example, some power burst events can be ended after a threshold amount of energy (e.g., burst energy) has been expended, after a threshold proportion or sum of available energy has been expended, or upon detection that a power machine is operating in a different state (e.g., based on detection of decreased loading by one or more sensors or reduced operator inputs). In some embodiments, a later (e.g., second) power burst event may not be permitted until after a predetermined (or other) recovery interval has elapsed following the end of an earlier (e.g., first) power burst event or where operational conditions for re-activating power burst mode are no longer met. For example, where a previous power burst mode raised battery temperature above a threshold operational condition and has yet to lower back down below the threshold.

Figure 8:
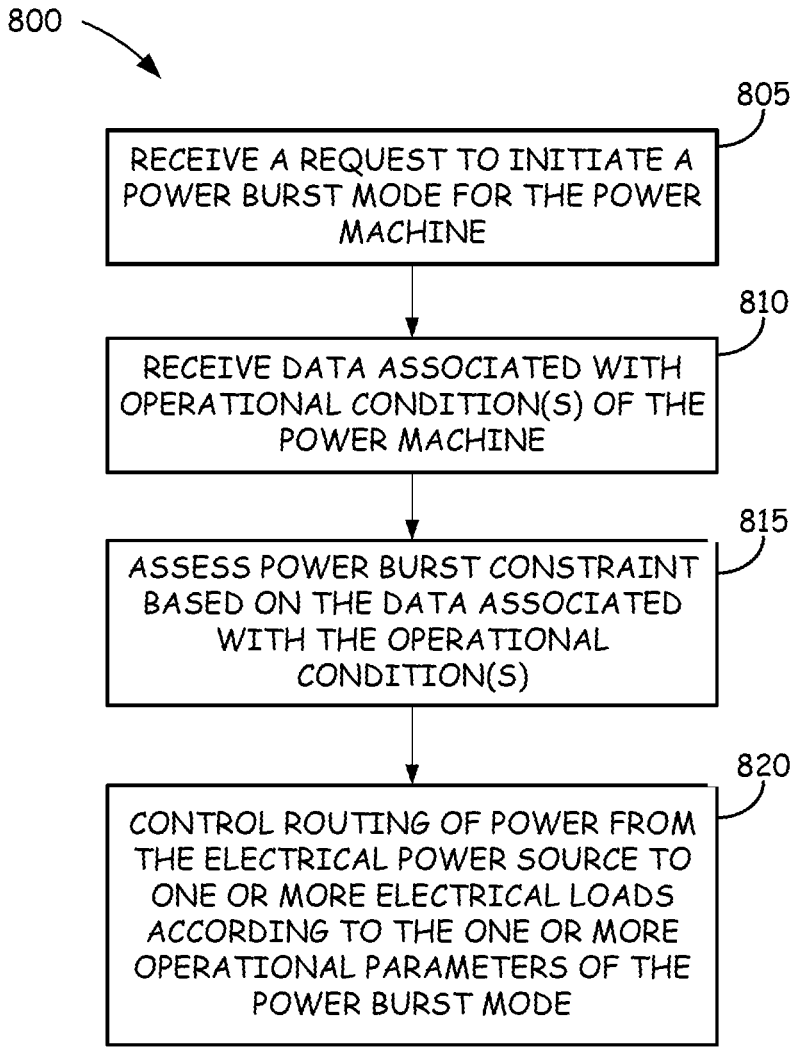
FIG. 8 illustrates a flowchart of a process for operating an electrically powered power machine according to a power burst mode.

As a particular example, FIG. 8 illustrates a flowchart of a process 800 for operating an electrically powered power machine according to a power burst mode, which can be implemented using one or more computing devices (e.g., a control device including the control device 404, the control device 546, etc.). In addition, the process 800 may be implemented for any of the power machines described herein, such as, for example, the power machine 400, the electrically powered power machine 500, etc.

As illustrated in FIG. 8, the process 800 includes receiving, with the control device 546, a request to initiate a power burst mode for the power machine (at block 805). As noted above, a power management mode may define one or more operational parameters for controlling routing or consumption of power to or by one or more electrical loads of the power machine. As one non-limiting example, a power management mode may define operational parameter(s) for adjusting (i.e., increasing or decreasing) an amount of power routed from the electrical power source 526 to a plurality of electrical actuators (e.g., the lift electrical actuator 518, the electrical tilt actuator 522, the drive system 528, the climate control system 536, etc.). As another non-limiting example, a power management mode may define operational parameter(s) for adjusting an amount of power used by at least one of the plurality of electrical actuators (e.g., when the at least one of the plurality of electrical actuators self-regulates power draw). For example, commands to a motor controller can cause the controller to temporarily demand power that exceeds a standard (or other) threshold. Thus, generally, a power burst mode is a power management mode that defines one or more operational parameters for increasing an amount of power routed to or used by one or more electrical loads.

In some embodiments, the control device 546 receives the request from an operator input device of the power machine. For example, as described in greater detail above, the power machine may include one or more operator input devices, which may include, e.g., an actuatable button. In such embodiments, an operator of the power machine may use the operator input device(s) to request initiation of the power burst mode (e.g., to operate generally in a power burst mode or to execute a particular power burst event) by actuating, pressing, or otherwise interacting with the operator input device(s). Accordingly, the control device 546 may receive the request in the form of operator input (indicative of the operator interacting with the operator input device(s)).

Alternatively, or in addition, the control device 546 may initiate the request for a power burst mode without direct operator input. In such embodiments, the control device 546 may monitor and detect one or more burst mode conditions associated with the power machine. A burst mode condition may refer to an operational state, a parameter, a characteristic, or the like of the power machine that is indicative of a potential need or desire for a power burst. For example, a power burst condition may be detected based on detecting one or more operational conditions that are indicative of the power machine struggling to perform a work operation or task (e.g., drive or lift actuators stalling (e.g., large error between position control and sensed position)). In other words, a power burst condition may be detected based on suddenly having insufficient power to execute a commanded movement. As one example, when the control device 546 detects that the power machine is struggling to traverse an incline, the control device 546 may detect a power burst condition corresponding to the tractive effort on the incline. As another example, when the one or more operational conditions are indicative of a sudden increase in loading on tractive elements despite no change in overall power machine attitude, the control device 546 may detect a power burst condition corresponding to tractive effort to push through a spoil pile. Thus, generally, a burst mode condition may refer to a wide variety of present operational states, parameters, characteristics, or the like associated with the power machine, including, for example, a digging operation, a tractive operation (e.g., moving forward or backwards), an implement operation (e.g., extending or retracting an implement of the power machine), or the like. In some examples, a burst mode condition can be determined based on operator input (e.g., based on comparing operator input with predetermined input profiles that indicate particular operations or states of a power machine).

In some embodiments, in response to detecting a power burst condition, the control device 546 can automatically initiate the request for the power burst mode. Alternatively, or in addition, in some embodiments, in response to detecting the power burst condition, the control device 546 may provide an indication to the operator of the power machine of the power burst condition (e.g., informing the operator that the power burst mode may be beneficial to the power machine). The control device 546 may provide the indication to the operator via a human machine interface, such as, e.g., a display device, of the power machine and the operator, as appropriate, may provide a request to initiate power burst mode.

In some embodiments, an operational condition is a sensed operational condition or can be otherwise determined based on sensed data for a power machine. For example, as described above, in some embodiments, a power machine may include one or more sensors that may collect or detect data associated with the power machine (e.g., data associated with one or more operational conditions of the power machine). For example, the one or more sensors may include a torque sensor, a position sensor, an angle sensor, a speed sensor, an acceleration sensor, an accelerometer, or the like. Alternatively, or in addition, in some embodiments, the power machine includes a temperature sensor. The temperature sensor may be configured to detect a current or present temperature associated with one or more components of the power machine. As one example, a temperature sensor may be associated with an electrical actuator and configured to detect temperature data associated with the electrical actuator (e.g., the operation or control of the electrical actuator).

Alternatively, or in addition, in some embodiments, the sensors may be implemented or integrated within a component of the power machine, a system associated with the component of the power machine, or the like. A sensor may be a pre-existing component of the component, a system associated with the component, or the like. As one example, the electronics associated with an electrical actuator may include a temperature sensor (or temperature sensing functionality). In such embodiments, the electronics associated with the electrical actuator may generate and transmit a CAN message indicating a current temperature reading associated with the electrical actuator to a control system of the power machine (e.g., the control device 546). In some embodiments, temperature can be sensed for (e.g., at) electronic circuitry that directly controls an electrical actuator, including an electronic motor drive for a motor or other similar devices.

Before, after, or while receiving the request (at block 805), the control device 546 may receive (or access) data associated with one or more operational conditions of the power machine (at block 810), which can be used to assess a power burst constraint, as further discussed below. As noted above, an operational condition may refer to an operational state, a parameter, a characteristic, or the like associated with the power machine. Additionally, an operational condition may be a sensed operational condition (e.g., sensed via one or more sensors associated with the power machine). The data associated with the one or more operational conditions may be associated with a geometric or structural condition of the power machine, such as, for example, a current position, tilt, torque, angle, speed, or the like of the power machine, workgroup, or an implement thereof. Alternatively, or in addition, the data associated with the one or more operational conditions may be indicative of a maneuver or operation currently being performed by the power machine, such as, e.g., a digging operation, a tractive operation, or the like. Alternatively, or in addition, the data associated with the one or more operational conditions may be indicative of a temperature associated with an electrical load of the power machine. Alternatively, or in addition, the data associated with the one or more operational conditions may be indicative of a component or the power machine that is currently experiencing stress or strain. As one example, the data associated with the one or more operational conditions may indicate that the power machine is currently performing a digging operation, where the digging operation is associated with a specific angle, position, torque, speed, or the like. As another example, the data associated with the one or more operational conditions may indicate a current temperature or load experienced by an electronic actuator associated with an implement of the power machine, such as a lift arm, a bucket, a tractive element, or the like.

As also noted above, in some embodiments, the data associated with the one or more operational conditions of the power machine may be sensed operational conditions. Accordingly, in such embodiments, the control device 546 may receive the sensed operational conditions (as sensor data) from one or more sensors of the power machine.

Generally, the method 800 can include assessing one or more power burst constraints (at block 815) based on one or more relevant operational conditions (as received at block 810) to determine whether to initiate a power burst mode in response to the received request (at block 805). As noted above, a power burst constraint can be any variety of thresholds or other conditions to be met relative to a burst mode or burst event. In some embodiments, a power burst constraint may be a threshold value (e.g., a threshold time, temperature, energy capacity, total power consumption, etc.). For example, the control device 546 may compare data associated with one or more operational conditions to a power burst threshold (at block 815). A power burst threshold may be a predefined threshold and may generally be based on conditions or values that would preclude initiation of the power burst mode. For example, in some contexts or under some operating conditions, initiation of the power burst mode may pose a risk of damage to the power machine, may be unnecessary, or may be otherwise inadvisable. Accordingly, for one or more specific operational conditions (or combinations thereof), under which the control device 546 will not initiate the power burst mode (e.g., may reject the request to initiate the power burst mode). In some embodiments, accordingly, a power burst threshold may be set based on a corresponding limit associated with a particular operational condition (e.g., a temperature or power limit). In other words, each power burst threshold may be associated with a particular operational condition and each power burst threshold may be defined based on a limit associated with the corresponding operational condition.

In some embodiments, a power burst threshold may be a temperature threshold associated with an electrical load. As one example, the power burst threshold may be set based on a maximum recommended temperature for an electrical actuator. Following this example, when the temperature data for the electrical actuator (as data associated with an operational condition) is below this power burst threshold, the control device 546 may determine that the data associated with the operational condition (i.e., the temperature data for the electrical actuator) satisfies the power burst threshold and absent any other operational conditions that do not meet the corresponding power burst threshold the power burst request will be initiated. Alternatively, when the temperature data for the electrical actuator is above this threshold, the control device 546 may determine that the data associated with the operational condition (i.e., the temperature data for the electrical actuator) does not satisfy the threshold and therefore the power burst request will be denied. Alternatively, or in addition, in some embodiments, a power burst threshold is associated with a geometric or structural limit associated with the power machine. As one example, the power burst threshold may include a set of operational conditions or values that represent one or more geometric or structural limits of the power machine (or component(s) thereof). For example, availability of power burst mode or limits on a particular power burst event can be defined based on potential loading scenarios for different configurations of a power machine (e.g., lift arm lowered to stops, lift arm partially raised, etc., so as to prevent up-rated power delivery during a power burst event from resulting in structural damage to the power machine). In one specific embodiment, a load condition on a lift arm actuator in conjunction with a substantially extended position of the actuator increases the likelihood of a failure event when the actuator is subject to any lateral forces in addition to an axial load. In such a condition, a power burst mode may be denied. Alternatively, or in addition, in some embodiments, the power burst threshold is set based on a torque limit, a tilt limit, an angle limit, a speed limit, or the like.

In some embodiments, the control device 546 may compare the data to more than one power burst threshold or other power burst constraint. For example, as noted above, each power burst threshold may be associated with a particular operational condition and each power burst threshold may be defined based on a limit associated with the corresponding operational condition. As one example, when the data includes temperature data associated with a first electrical actuator and tilt data associated with a second electrical actuator, the control device 546 may compare the temperature data to a power burst threshold associated with a temperature threshold and the tilt data to a different power burst threshold associated with a tilt threshold.

In response to the data satisfying the power burst constraint (e.g., based on the comparison performed at block 815), the control device 546 controls routing of power from the electrical power source to select one or more electrical loads according to the one or more operational parameters of the power burst mode (at block 820). In some embodiments, the operational parameters of the power burst mode may define or control routing of power from the electrical power source to one or more electrical loads. For example, the operational parameters may define which electrical loads may receive an increase in power delivery under particular operational conditions (etc.), and how much of an increase in power delivery the electrical loads may receive (e.g., under given operational conditions). The degree of or increase amount of power delivered to a specific component (i.e., electrical load) may be based on the data associated with one or more operational conditions and different operational conditions may warrant different increases of power. As one example, under a first set of operational conditions, the control device 546, based on the operational parameters of the power burst mode, may increase power delivered to the drive system by 50% in comparison to power delivered during normal operation of the power machine. However, under a second set of operational conditions, the control device 546, based on the operational parameters of the power burst mode, may increase power delivered to the drive system by 25% in comparison to power delivered during normal operation of the power machine. That is, in various embodiments, the power burst determination may not only be a binary decision (e.g., a yes or no decision), but may consider the sensed operational conditions and allow for varying degrees of power bursts.

Alternatively, or in addition, different operational conditions may warrant increased power delivery to different components (i.e., electrical loads). As one example, under a third set of operational conditions, the control device 546, based on the operational parameters of the power burst mode, may increase power delivered to an electrical actuator associated with a traction element but may not increase power delivered to a different electrical actuator associated with a lift arm. However, under a fourth set of operational conditions, the control device 546, based on the operational parameters of the power burst mode, may increase power delivered to an electrical actuator associated with a lift arm but may not increase power delivered to a different electrical actuator associated with a tractive element (for example). In yet other embodiments, the electrical system of the power machine may not limit power delivery to the one or more subsystems. Instead, the various motor controllers may have default current draw limits which may be temporarily withdrawn or the limits may be increased in a power burst mode.

As also noted above, a power burst mode (or event thereof) can be ended based on various termination conditions (e.g., as part of operations at block 820). In some embodiments, the control device 546 may limit a duration associated with the power burst mode or a particular power burst event (e.g., a termination condition can be associated with a predetermined maximum period of time during which the power burst mode may be implemented). Thus, for example, the control device 546 may end operation in a power burst mode or end a power burst event after a predetermined amount of time (such as, e.g., five seconds or 1 minute). In some embodiments, a period of time associated with a termination condition may vary depending on the particular actuator (e.g., drive vs. lift actuators), on a characteristic of the increase in power (e.g., a relative or absolute magnitude of the increase), on a current capacity of a power source (e.g., a charge level of a battery), etc. An operator input may also deactivate a power burst mode, in some examples.

In some embodiments, a termination condition is associated with one or more operational conditions of the power machine failing to satisfy an applicable power burst constraint (e.g., threshold). In such embodiments, for example, the control device 546 may end the power burst mode when the data associated with the one or more operational conditions of the power machine indicates that the power burst constraint is no longer met (e.g., a value now exceeds, or no longer exceeds, a relevant threshold). As one example, the control device 546 may end the power burst mode when a temperature reading associated with an electrical actuator exceeds a power burst threshold (e.g., representing a recommended maximum temperature). Alternatively, or in addition, in some embodiments, the termination condition is associated with a state transition from, e.g., a current operational state of the power machine to a new operational state of the power machine. In such embodiments, for example, the control device 546 may end the power burst mode when the control device 546 detects a state transition. For example, when the power machine is currently performing a digging operation in the power burst mode, the control device 546 may end the power burst mode once the operational conditions indicate that the power machine is no longer performing the digging operation (e.g., no longer in a digging state).

In some embodiments, in response to a power burst constraint not being satisfied (e.g., based on the comparison performed at block 815), the control device 546 may not initiate the power burst mode. For example, when the power burst constraint is not satisfied, the control device 546 may effectively ignore the request permanently (e.g., deny or otherwise not fulfill the request) or temporarily (e.g., postpone further consideration or fulfill the request once all operational conditions are met). Thus, in some cases, an operator may request a power burst mode at an operator input device while a power burst constraint is not satisfied, and the control device 546 may ignore the request, or at least delay fulfilling the request, until after a change in one or more operational conditions results in the power burst constraint being satisfied. In some specific embodiments, the control device 546 may continuously run blocks 810 and 815 in the background. When burst mode is available, a visible indicator may be provided to the operator.

In some embodiments, after ending operation under a power burst mode, the control device 546 may receive subsequent requests to initiate (or re-initiate) operation under the power burst mode for the power machine. For example, after ending a first power burst event of the power burst mode, the control device 546 may receive a second request to initiate a second power burst event (e.g., of the same power burst mode). In some embodiments, in response to receiving such a subsequent request, the control device 546 may implement or not implement the requested second burst event based on whether the subsequent event relates to one or more electrical actuators that were previously involved in the first power burst event and whether the one or more actuators have recovered from the previous event (i.e., operation conditions met for the subsequent event).

In some embodiments, the control device 546 can determine whether subsequent operation under a power burst mode is appropriate based on temporal information, including whether a sufficient (e.g., minimum threshold) recovery time has occurred with respect to at least the one or more electrical actuators that received an increased power delivery. For example, the control device 546 may determine a period of time that has elapsed since the ending of a first power burst event. To determine a response to receipt of a second request for a second power burst event, the control device 546 may then compare the elapsed time to a recovery time threshold (e.g., as may define or represent an amount of time necessary for the electrical actuator(s) that received an increased power delivery to recover from the increased power delivery), and may implement the second power burst event only if the elapsed time exceeds the time threshold. Alternatively, or in addition, the control device 546 may determine whether an electrical actuator that received an increased power delivery has sufficiently recovered based on one or more operational conditions (e.g., sensed data) associated with that electrical actuator. As one example, the control device 546 may monitor a temperature (as an operational condition) of an electrical actuator that received an increased power delivery. Once the temperature associated with that electrical actuator has returned to normal levels (e.g., satisfies the power burst threshold), the control device 546 may determine that that electrical actuator has recovered from the previous increased power delivery.

As appropriate (e.g., after determining that the one or more relevant electrical actuators have recovered from the previous increase in power delivery), the control device 546 may repeat blocks 805, 810, and 815 of process 800, in various combinations and iterations. For example, the control device 546 may receive subsequent data associated with one or more subsequent operational conditions of the power machine and compare the subsequent data to the power burst threshold associated with the power burst mode, as similarly described above with respect to blocks 810 and 815 of process 800. In response to the subsequent data satisfying the power burst threshold, the control device 546 may initiate the second power burst event for the power machine (based on the one or more operational parameters associated with the power burst mode). In some embodiments, the subsequent initiations of the power burst mode (e.g., as a second power burst event, a third power burst event, or the like) may be associated with the same or different operating conditions (e.g., a same operational state of the power machine), electrical actuators, termination conditions, or the like.

In some embodiments, aspects of the invention, including computerized implementations of methods according to the invention, can be implemented as a system, method, apparatus, or article of manufacture using standard programming or engineering techniques to produce software, firmware, hardware, or any combination thereof to control a processor device (e.g., a serial or parallel general purpose or specialized processor chip, a single- or multi-core chip, a microprocessor, a field programmable gate array, any variety of combinations of a control unit, arithmetic logic unit, and processor register, and so on), a computer (e.g., a processor device operatively coupled to a memory), or another electronically operated controller to implement aspects detailed herein. Accordingly, for example, embodiments of the invention can be implemented as a set of instructions, tangibly embodied on a non-transitory computer-readable media, such that a processor device can implement the instructions based upon reading the instructions from the computer-readable media. Some embodiments of the invention can include (or utilize) a control device such as an automation device, a special purpose or general purpose computer including various computer hardware, software, firmware, and so on, consistent with the discussion below. As specific examples, a control device can include a processor, a microcontroller, a field-programmable gate array, a programmable logic controller, logic gates etc., and other typical components that are known in the art for implementation of appropriate functionality (e.g., memory, communication systems, power sources, user interfaces and other inputs, etc.).

The term "article of manufacture" as used herein is intended to encompass a computer program accessible from any computer-readable device, carrier (e.g., non-transitory signals), or media (e.g., non-transitory media). For example, computer-readable media can include but are not limited to magnetic storage devices (e.g., hard disk, floppy disk, magnetic strips, and so on), optical disks (e.g., compact disk (CD), digital versatile disk (DVD), and so on), smart cards, and flash memory devices (e.g., card, stick, and so on). Additionally, it should be appreciated that a carrier wave can be employed to carry computer-readable electronic data such as those used in transmitting and receiving electronic mail or in accessing a network such as the Internet or a local area network (LAN). Those skilled in the art will recognize that many modifications may be made to these configurations without departing from the scope or spirit of the claimed subject matter.

Certain operations of methods according to the invention, or of systems executing those methods, may be represented schematically in the FIGS. or otherwise discussed herein. Unless otherwise specified or limited, representation in the FIGS. of particular operations in particular spatial order may not necessarily require those operations to be executed in a particular sequence corresponding to the particular spatial order. Correspondingly, certain operations represented in the FIGS., or otherwise disclosed herein, can be executed in different orders than are expressly illustrated or described, as appropriate for particular embodiments of the invention. Further, in some embodiments, certain operations can be executed in parallel, including by dedicated parallel processing devices, or separate computing devices configured to interoperate as part of a large system.

As used herein in the context of computer implementation, unless otherwise specified or limited, the terms "component," "system," "module," "block," and the like are intended to encompass part or all of computer-related systems that include hardware, software, a combination of hardware and software, or software in execution. For example, a component may be, but is not limited to being, a processor device, a process being executed (or executable) by a processor device, an object, an executable, a thread of execution, a computer program, or a computer. By way of illustration, both an application running on a computer and the computer can be a component. One or more components (or system, module, and so on) may reside within a process or thread of execution, may be localized on one computer, may be distributed between two or more computers or other processor devices, or may be included within another component (or system, module, and so on).

Also as used herein, unless otherwise limited or defined, "or" indicates a non-exclusive list of components or operations that can be present in any variety of combinations, rather than an exclusive list of components that can be present only as alternatives to each other. For example, a list of "A, B, or C" indicates options of: A; B; C; A and B; A and C; B and C; and A, B, and C. Correspondingly, the term "or" as used herein is intended to indicate exclusive alternatives only when preceded by terms of exclusivity, such as "either," "one of," "only one of," or "exactly one of." Further, a list preceded by "one or more" (and variations thereon) and including "or" to separate listed elements indicates options of one or more of any or all of the listed elements. For example, the phrases "one or more of A, B, or C" and "at least one of A, B, or C" indicate options of: one or more A; one or more B; one or more C; one or more A and one or more B; one or more B and one or more C; one or more A and one or more C; and one or more of each of A, B, and C. Similarly, a list preceded by "a plurality of" (and variations thereon) and including "or" to separate listed elements indicates options of multiple instances of any or all of the listed elements. For example, the phrases "a plurality of A, B, or C" and "two or more of A, B, or C" indicate options of: A and B; B and C; A and C; and A, B, and C. In general, the term "or" as used herein only indicates exclusive alternatives (e.g. "one or the other but not both") when preceded by terms of exclusivity, such as "either," "one of," "only one of," or "exactly one of."

Although the present invention has been described by referring to preferred embodiments, workers skilled in the art will recognize that changes may be made in form and detail without departing from the scope of the discussion.

What is claimed is:

1. A power machine comprising:

a main frame;

one or more work elements coupled to the main frame;

a plurality of electrical actuators coupled to the main frame and configured to operate the one or more work elements;

an electrical power source configured to power the plurality of electrical actuators; and a control device in communication with the plurality of electrical actuators, the control device being configured to:

during operation of the power machine in a standard operating mode, receive a request to initiate a power burst mode for the power machine, wherein the power burst mode defines one or more operational parameters for increasing an amount of power used by at least one of the plurality of electrical actuators above a power threshold for the standard operating mode;

compare one or more operational conditions of the power machine to one or more power burst thresholds associated with the power burst mode, wherein the one or more power burst thresholds are associated with one or more values that preclude initiation of the power burst mode, and the one or more operational conditions of the power machine satisfy the one or more power burst thresholds when the one or more operational conditions are within a range specified by the one or more values; and in response to the comparison indicating that at least one power burst threshold of the one or more power burst thresholds has been satisfied by the one or more operational conditions being within the range, control an increase of power to the at least one of the plurality of electrical actuators according to the one or more operational parameters of the power burst mode.

2. The power machine of claim 1, wherein the one or more operational conditions of the power machine are determined based on temperature data associated with at least one electrical actuator included in the plurality of electrical actuators.

3. The power machine of claim 2, wherein the temperature data associated with the at least one electrical actuator is associated with electronic circuitry that directly controls the electrical actuator.

4. The power machine of claim 1, wherein the one or more operational conditions of the power machine are determined based on one or more of torque data, position data, actuator position data, or speed data of the at least one of the plurality of electrical actuators.

5. The power machine of claim 1, wherein the control device is configured to receive the request to initiate the power burst mode from an operator input device of the power machine.

6. The power machine of claim 5, wherein the operator input device is configured to provide commands for movement of the at least one of the plurality of electrical actuators based on operator inputs relative to a first degree of freedom of the operator input device, and to receive the operator input request to initiate the power burst mode relative to a second, different degree of freedom of the operator input device.

7. The power machine of claim 1, wherein the control device is configured to detect a power burst condition associated with the power machine, wherein the request is received in response to detecting the power burst condition.

8. The power machine of claim 7, wherein the one or more operational conditions of the power machine are determined based on sensor data received from one or more sensors of the power machine.

9. The power machine of claim 1, wherein the control device is configured to control routing of power from the electrical power source to increase the power to the at least one of the plurality of electrical actuators for a predetermined period of time.

10. The power machine of claim 1, wherein the control device is configured to control routing of power from the electrical power source to increase the power to the at least one of the plurality of electrical actuators according to the one or more operational parameters of the power burst mode until the power burst threshold is no longer satisfied.

11. The power machine of claim 1, wherein the control device is configured to control routing of power from the electrical power source to increase the power to the at least one of the plurality of electrical actuators according to the one or more operational parameters of the power burst mode until the control device detects a transition from a current operational state of the power machine to a new operational state of the power machine.

12. The power machine of claim 1, wherein the power burst threshold is a temperature threshold associated with that at least one of the plurality of electrical actuators.

13. The power machine of claim 1, wherein the power machine includes a lift arm operably coupled to the main frame and an implement carrier pivotally coupled to the lift arm, and wherein the power burst threshold is based on a geometric or structural limit relative to a position of the implement carrier relative to the lift arm or a position of the lift arm relative to the main frame.

14. The power machine of claim 1, wherein the at least one of the plurality of electrical actuators includes at least one drive actuator of the power machine, so that the increase in power to the at least one of the plurality of electrical actuators increases tractive power for the power machine.

15. The system of claim 1, wherein the one or more operational conditions are within the range when the one or more operational conditions fall below a value of the at least one power burst threshold.

* * * * *